US012570434B2

(12) United States Patent
Spahlinger

(10) Patent No.: US 12,570,434 B2
(45) Date of Patent: Mar. 10, 2026

(54) CARTON WITH LOCKING FEATURES

(71) Applicant: GPI Frankfurt & Augsburg GmbH, Kriftel (DE)

(72) Inventor: Carolin Spahlinger, Hattersheim am Main (DE)

(73) Assignee: Graphic Packaging International, LLC, Atlanta, GA (US)

( * ) Notice: Subject to any disclaimer, the term of this patent is extended or adjusted under 35 U.S.C. 154(b) by 135 days.

(21) Appl. No.: 18/239,188

(22) Filed: Aug. 29, 2023

(65) Prior Publication Data

US 2024/0067392 A1 Feb. 29, 2024

(51) Int. Cl.

| | |
|---|---|
| ***B65D 5/68*** | (2006.01) |
| ***B65D 5/20*** | (2006.01) |
| ***B65D 5/38*** | (2006.01) |

(52) U.S. Cl.

CPC ..... *B65D 5/685* (2013.01); *B65D 5/20* (2013.01); *B65D 5/38* (2013.01)

(58) Field of Classification Search

CPC ..... B65D 5/38; B65D 2215/02; B65D 5/685; B65D 65/46; B65D 5/4608; B65D 5/6608; B65D 5/68; B65D 50/046

USPC ..... 206/1.5, 267, 273, 363, 427, 232, 521, 206/815, 216

See application file for complete search history.

(56) References Cited

U.S. PATENT DOCUMENTS

| | | | |
|---|---|---|---|
| 1,048,577 | A | 12/1912 | Pardoe, Jr. |
| 1,130,271 | A | 3/1915 | Hammond |
| 1,253,489 | A | 1/1918 | Houghland |
| 1,664,308 | A | 3/1928 | Miller |
| 1,951,274 | A | 3/1934 | Denman |
| 2,054,596 | A | 9/1936 | Ford |
| 2,069,281 | A | 2/1937 | Sebreny |

(Continued)

FOREIGN PATENT DOCUMENTS

| | | |
|---|---|---|
| AT | 334276 B | 1/1976 |
| CH | 412695 | 4/1966 |

(Continued)

OTHER PUBLICATIONS

U.S. Appl. No. 18/036,248, filed May 10, 2023.

(Continued)

*Primary Examiner* — Steven A. Reynolds
*Assistant Examiner* — Prince Pal
(74) *Attorney, Agent, or Firm* — Andrew N. Claerbout; FisherBroyles, LLC

(57) ABSTRACT

A carton comprising an inner construct comprising a plurality of inner panels extending at least partially around a first interior, an inner locking tab foldably connected to at least one inner panel, and at least one inner locking flap foldably connected to the at least one inner panel. An outer construct can comprise a plurality of outer panels extending at least partially around a second interior. The outer construct can comprise an outer locking tab foldably connected to at least one outer panel, and the inner locking tab and the inner locking flap cooperate with the outer locking tab to limit movement between the inner construct and the outer construct at a locked position. The inner locking flap being moveable relative to the at least one inner panel to create an audible locking sound upon positioning the inner construct to the locked position.

27 Claims, 8 Drawing Sheets

(56) References Cited

U.S. PATENT DOCUMENTS 2,180,808 A 11/1939 Jacobstein
2,194,220 A 3/1940 Elder
2,251,283 A * 8/1941 Johnson ..... B65D 75/5888 229/210
2,331,754 A * 10/1943 Friedrich ..... B65D 5/6608 229/160
2,335,363 A 11/1943 Shelton
2,369,387 A 2/1945 Williamson
2,396,310 A 3/1946 Yungblut
2,474,523 A * 6/1949 Guyer ..... B65D 5/542 229/920
2,559,320 A * 7/1951 Rushing ..... B65D 5/685 229/125.26
2,610,770 A 9/1952 Penfield
2,745,589 A * 5/1956 Daly ..... B65D 5/685 229/125.26
2,777,630 A * 1/1957 Moberger ..... B65D 43/0222 229/125.28
2,836,343 A 5/1958 Will
2,877,736 A 3/1959 Simmons
2,898,004 A 8/1959 Klausmann et al.
2,943,769 A 7/1960 Klausmann
2,970,742 A * 2/1961 Fleisig ..... B65D 5/685 229/921
2,975,952 A 3/1961 Tamarin
2,980,540 A 4/1961 Turpin
2,983,424 A 5/1961 Glass
3,033,436 A 5/1962 Peimer
3,040,953 A 6/1962 Tindall
3,055,362 A 9/1962 Uytenbogaart
3,057,524 A 10/1962 Shanks
3,071,882 A 1/1963 Eisman
3,099,381 A 7/1963 Meyers
3,114,474 A 12/1963 Davis
3,116,007 A 12/1963 D Esposito
3,166,229 A 1/1965 Sherman et al.
3,187,961 A 6/1965 Moore
3,205,603 A 9/1965 Brumley
3,235,144 A 2/1966 Pitkin et al.
3,240,419 A 3/1966 Spiering
3,298,576 A 1/1967 Sellors
3,302,847 A 2/1967 Hennesey
3,310,222 A 3/1967 Buttery
3,347,446 A 10/1967 Guyer et al.
3,366,496 A * 1/1968 Bomar ..... B65D 5/4295 426/410
RE26,557 E 3/1969 Houston
3,441,002 A 4/1969 Lawalin et al.
3,512,699 A * 5/1970 Wilson ..... B65D 5/0227 229/102
3,533,547 A * 10/1970 Houston ..... B65D 5/22 229/172
3,563,449 A 2/1971 Forbes, Jr.
3,692,231 A * 9/1972 Neitzke ..... B65D 5/685 206/815
3,741,387 A 6/1973 Whitecar
3,804,321 A 4/1974 Forbes, Jr.
3,831,833 A 8/1974 Dressler et al.
3,888,350 A 6/1975 Horvath
3,894,680 A 7/1975 Araki
3,899,121 A * 8/1975 Herbetko ..... B65D 5/22 229/179
3,910,487 A 10/1975 Jaeschke
3,921,862 A 11/1975 Holmstrom
3,958,744 A 5/1976 Herglotz
3,971,505 A 7/1976 Ohkubo
3,981,434 A 9/1976 Ramich
4,004,691 A 1/1977 Wihksne
4,053,100 A * 10/1977 Baptist ..... B65D 5/685 229/125.26
4,076,117 A 2/1978 Wisdom
4,081,128 A 3/1978 O'Neill
4,083,455 A * 4/1978 Keating, Jr. ..... B65D 5/5405 229/226
4,094,456 A 6/1978 Raccaforte
4,102,457 A 7/1978 Meyers
4,111,351 A 9/1978 Forbes, Jr.
4,113,086 A 9/1978 Forbes, Jr.
4,138,016 A 2/1979 Roccaforte
4,141,485 A 2/1979 Lambert
4,196,483 A 4/1980 Kahl, Jr.
4,196,843 A * 4/1980 Garmon ..... B65D 5/685 229/165
4,197,985 A 4/1980 Austin
4,201,329 A 5/1980 Roccaforte
4,261,483 A 4/1981 Dutcher
4,279,373 A 7/1981 Montealgre
4,304,355 A * 12/1981 Sykora ..... B65D 5/68 229/125.26
4,341,338 A 7/1982 Emmons
4,342,417 A 8/1982 Forbes, Jr.
4,361,270 A 11/1982 Roccaforte
4,401,210 A 8/1983 Gunnar
4,441,648 A 4/1984 Portsmouth
4,472,896 A 9/1984 Brauner
4,531,669 A 7/1985 Osborne
4,550,834 A 11/1985 Fletcher
4,609,142 A 9/1986 Adamek
4,630,733 A 12/1986 Fear
4,684,023 A 8/1987 Cortopassi
4,717,070 A * 1/1988 Taub ..... B65D 5/685 229/117.16
4,812,704 A 3/1989 Van der Ven
4,834,255 A 5/1989 Boots
4,892,247 A * 1/1990 Dirksing ..... B65D 15/22 229/125.32
4,901,457 A 2/1990 Chandler
5,040,722 A * 8/1991 Fromion ..... B65D 5/6667 229/148
5,050,794 A * 9/1991 Wischusen, III ..... B65D 5/248 229/179
D320,743 S 10/1991 Alexander
5,056,708 A 10/1991 Boyle et al.
5,058,803 A 10/1991 Gulliver
5,103,972 A * 4/1992 Ackeret ..... B42F 7/14 229/120.08
RE33,979 E 6/1992 Cortopassi
5,154,343 A 10/1992 Stone
5,161,734 A * 11/1992 Ruehl ..... B65D 5/5415 229/223
5,205,478 A 4/1993 Wiscusen, III
D342,446 S 12/1993 Parker
D345,272 S 3/1994 Kelsoe
5,299,732 A * 4/1994 Armor ..... B65D 5/46024 229/117.22
D346,552 S 5/1994 Krupa
5,429,297 A 7/1995 Walsh
5,439,133 A 8/1995 Stone
5,450,998 A 9/1995 Esse
5,465,834 A 11/1995 Sieber et al.
5,503,268 A 4/1996 Pham
5,505,374 A 4/1996 Stone
5,511,722 A 4/1996 Dixon
5,515,996 A 5/1996 Stone
5,518,172 A * 5/1996 Nanno ..... B65D 5/0272 229/148
5,542,540 A 8/1996 Knapp
5,551,938 A 9/1996 Stone
5,627,150 A 5/1997 Peterson
5,628,533 A * 5/1997 Hill ..... E05C 19/06 292/DIG. 38
D379,759 S 6/1997 Mulry
5,662,265 A 9/1997 Jensen
5,690,273 A 11/1997 Jensen
5,697,549 A 12/1997 Yocum
5,725,144 A * 3/1998 Stone ..... B65D 5/6608 229/101
5,810,250 A 9/1998 Stone et al.
5,826,781 A 10/1998 Jensen
5,875,962 A 3/1999 Jorgensen-Beck et al.
5,875,963 A 3/1999 Stone
6,027,018 A 2/2000 Yocum

(56) References Cited

U.S. PATENT DOCUMENTS 6,041,997 A 3/2000 Jensen
6,047,829 A 4/2000 Johnstone
6,068,181 A 5/2000 Cai
6,105,855 A 8/2000 Kackstetter
6,138,904 A * 10/2000 Baird ..... B65D 5/0075 229/199
D437,222 S 2/2001 Goldberg
6,213,388 B1 4/2001 Ours et al.
6,230,893 B1 5/2001 Karow
6,296,175 B1 * 10/2001 Dixon ..... B65D 5/685 229/102
6,318,593 B1 11/2001 Laughlin et al.
D458,127 S 6/2002 Hendrik
D460,691 S 7/2002 Morris
6,412,636 B1 7/2002 Jones
6,484,931 B1 * 11/2002 Hofte ..... B65D 5/6608 229/149
D467,499 S 12/2002 Garza
6,491,211 B1 12/2002 Evans
D472,463 S 4/2003 Kinigakis
D473,787 S 4/2003 Jones
6,575,299 B1 6/2003 Kinigakis
6,604,676 B2 * 8/2003 Giblin ..... B65D 5/543 229/148
6,641,031 B2 11/2003 Evans
D484,043 S 12/2003 Hwang
6,672,474 B2 * 1/2004 May ..... A47K 10/46 221/102
6,681,983 B2 1/2004 Bill-Moore
6,708,874 B1 * 3/2004 Montgomery ..... B65D 5/4608 206/815
6,749,108 B2 * 6/2004 Naughton ..... B65D 5/005 229/199
6,752,272 B2 6/2004 Jones
D499,022 S 11/2004 Sun
6,945,449 B2 9/2005 Hengami
6,957,765 B2 10/2005 Howell
7,156,286 B2 1/2007 Hengami
7,353,969 B2 4/2008 McHutchinson
7,377,385 B2 * 5/2008 Giannini ..... B65D 85/1072 229/125.125
7,389,875 B2 6/2008 Sandberg
7,473,215 B2 * 1/2009 Moen ..... B65D 5/323 493/128
7,503,475 B2 3/2009 McGowan
7,523,825 B2 4/2009 Velazquez
7,637,375 B2 12/2009 Sattel
7,658,318 B2 2/2010 Walsh
7,708,142 B2 5/2010 Ehrlund
7,726,552 B2 * 6/2010 Chadima ..... B65D 5/685 232/1 D
7,841,512 B2 * 11/2010 Westerman ..... B65D 5/6697 229/149
7,854,325 B2 12/2010 Bentele
8,056,799 B2 11/2011 Burke
8,443,978 B2 5/2013 Royer
8,453,840 B2 6/2013 Wharton
8,740,050 B2 6/2014 Zinck
8,746,444 B2 * 6/2014 Dehlin ..... B65D 5/38 220/345.4
8,800,855 B2 8/2014 Fitzwater
8,997,979 B2 * 4/2015 Ghini ..... B65D 5/38 206/267
9,359,123 B2 6/2016 Bhattacharjee
9,475,605 B2 10/2016 Everett
9,783,335 B2 * 10/2017 Everett ..... B65D 5/2057
9,881,788 B2 1/2018 Kim
9,981,788 B2 5/2018 Skinner
10,017,291 B2 7/2018 Smith
10,053,259 B2 8/2018 Gungner
10,086,972 B2 10/2018 Hajek
10,232,976 B2 3/2019 Waddington
10,442,600 B2 10/2019 Waltermire
10,479,581 B2 11/2019 Chambers
10,486,849 B2 11/2019 Parkes
10,494,138 B1 * 12/2019 Velliquette ..... B65D 5/446
10,618,684 B2 4/2020 Eckert
10,661,940 B2 5/2020 Hajek
D899,245 S 10/2020 Mori
10,934,072 B2 3/2021 Lantz
D921,982 S 6/2021 Gerhards
11,046,476 B2 * 6/2021 Whitehurst ..... B65D 79/00
11,059,621 B2 7/2021 Nowak
11,365,022 B2 6/2022 Altman
11,794,947 B2 10/2023 Hoefte
11,932,468 B2 3/2024 Hoefte
11,993,434 B2 5/2024 Hoefte
12,012,262 B2 6/2024 Zirollo
12,116,184 B2 10/2024 Hoefte
12,134,503 B2 11/2024 Hoefte
12,162,651 B2 12/2024 Hoefte
2002/0052302 A1 5/2002 Clark
2003/0047595 A1 3/2003 Bill-Moore
2003/0111523 A1 6/2003 Haugan
2003/0168502 A1 9/2003 Kisch
2003/0213722 A1 11/2003 Kinigakis
2003/0222130 A1 * 12/2003 Fukushima ..... B65D 5/4291 229/149
2004/0065723 A1 4/2004 Hengami
2004/0074953 A1 4/2004 Yocum
2004/0099565 A1 5/2004 Dehlin
2005/0017061 A1 * 1/2005 Quaintance ..... B65D 5/685 229/177
2006/0118451 A1 * 6/2006 Edwards ..... B65D 75/42 206/525.1
2006/0283928 A1 12/2006 Walsh
2007/0221713 A1 9/2007 Wilson
2007/0267467 A1 11/2007 Burke
2008/0054059 A1 * 3/2008 Chadima ..... B65D 5/685 229/102
2008/0217204 A1 9/2008 Sattel
2008/0217205 A1 9/2008 Sattel
2008/0257773 A1 10/2008 Gelardi
2008/0265010 A1 10/2008 Montague Kisch
2009/0001145 A1 1/2009 Hasse
2009/0032575 A1 2/2009 D Amato
2009/0152134 A1 * 6/2009 Katsis ..... B65D 5/38 206/96
2009/0184022 A1 7/2009 Coe
2011/0168767 A1 7/2011 Hengami
2011/0204087 A1 8/2011 Kopulos
2013/0193197 A1 * 8/2013 Low ..... B65D 5/308 229/146
2013/0256391 A1 * 10/2013 Jolley ..... B65D 5/36 229/103.2
2013/0306718 A1 11/2013 Sumpmann
2013/0313311 A1 11/2013 Fath et al.
2014/0339293 A1 11/2014 McLeod
2014/0346220 A1 11/2014 Saulas
2015/0034711 A1 2/2015 Pinkstone
2015/0060537 A1 3/2015 Hajek et al.
2015/0083789 A1 3/2015 Fitzwater et al.
2015/0183548 A1 7/2015 Cho
2015/0197386 A1 * 7/2015 Chang ..... B65D 5/64 206/514
2015/0232785 A1 8/2015 Paullin
2015/0267155 A1 9/2015 Brooker
2016/0096650 A1 4/2016 Jamison
2016/0122445 A1 5/2016 Nambiar
2016/0152373 A1 6/2016 Linssen
2016/0251107 A1 9/2016 Everett
2016/0264286 A1 * 9/2016 Pinkstone ..... B65D 5/6608
2017/0001751 A1 1/2017 Schow
2017/0001752 A1 * 1/2017 Ishikawa ..... B65D 5/64
2017/0008664 A1 * 1/2017 Parkes ..... B65D 5/6667
2017/0036808 A1 * 2/2017 Everett ..... B65D 5/38
2017/0062023 A1 3/2017 Datta
2017/0298308 A1 10/2017 Labeque
2017/0334600 A1 11/2017 Eckert
2018/0022498 A1 1/2018 Everett
2018/0099775 A1 4/2018 Van Waarden
2018/0215513 A1 8/2018 Perek

(56) References Cited

U.S. PATENT DOCUMENTS

| | | | | |
|---|---|---|---|---|
| 2018/0257827 | A1* | 9/2018 | Drosos | B65D 50/066 |
| 2018/0265816 | A1 | 9/2018 | Lintula | |
| 2018/0346846 | A1 | 12/2018 | Kropf | |
| 2019/0023448 | A1 | 1/2019 | Mehta | |
| 2019/0062023 | A1 | 2/2019 | Lantz et al. | |
| 2019/0084740 | A1 | 3/2019 | Davis et al. | |
| 2019/0135503 | A1* | 5/2019 | De Wilde | B65D 50/046 |
| 2019/0136153 | A1 | 5/2019 | Dicosimo | |
| 2019/0202942 | A1 | 7/2019 | Lu | |
| 2019/0291917 | A1* | 9/2019 | Curcic | B65C 3/18 |
| 2019/0344925 | A1 | 11/2019 | Block | |
| 2019/0390138 | A1 | 12/2019 | Sivik | |
| 2020/0002646 | A1 | 1/2020 | Huang | |
| 2020/0087020 | A1 | 3/2020 | Tsai et al. | |
| 2020/0180808 | A1* | 6/2020 | Gauvin | B65D 5/38 |
| 2020/0189813 | A1* | 6/2020 | Drosos | B65D 83/0463 |
| 2020/0331667 | A1 | 10/2020 | Bressan | |
| 2021/0016939 | A1* | 1/2021 | Palmer | B65D 5/38 |
| 2021/0047072 | A1* | 2/2021 | Ng Pak Leung | B65D 5/6608 |
| 2021/0053715 | A1 | 2/2021 | Tsai | |
| 2021/0171235 | A1* | 6/2021 | Boland | B65D 5/38 |
| 2021/0269191 | A1* | 9/2021 | Peterson | B65D 83/76 |
| 2021/0292056 | A1* | 9/2021 | Tidwell | A24F 23/00 |
| 2021/0347524 | A1* | 11/2021 | Hoefte | B65D 5/685 |
| 2022/0063877 | A1 | 3/2022 | Forenza | |
| 2022/0081155 | A1* | 3/2022 | Hoefte | B65D 5/443 |
| 2022/0144507 | A1* | 5/2022 | Ubell | B65D 50/046 |
| 2022/0169426 | A1* | 6/2022 | Drosos | B65D 83/0463 |
| 2022/0185534 | A1* | 6/2022 | Hoefte | B65D 5/6608 |
| 2022/0204210 | A1 | 6/2022 | Joines | |
| 2022/0250788 | A1* | 8/2022 | Bressan | B65D 5/685 |
| 2022/0289425 | A1 | 9/2022 | Green | |
| 2022/0289436 | A1* | 9/2022 | Hoefte | B65D 5/48014 |
| 2022/0306336 | A1* | 9/2022 | Bressan | B65D 5/685 |
| 2022/0315297 | A1 | 10/2022 | Zirollo | |
| 2022/0332460 | A1* | 10/2022 | Bressan | B65D 5/685 |
| 2022/0380097 | A1* | 12/2022 | Li | B65D 50/066 |
| 2023/0015201 | A1* | 1/2023 | Arango | B65D 5/38 |
| 2023/0113321 | A1* | 4/2023 | Bressan | B65D 5/38 206/1.5 |
| 2023/0132541 | A1* | 5/2023 | Hoefte | B65D 5/38 206/1.5 |
| 2023/0142224 | A1* | 5/2023 | Buck | B65D 5/38 53/492 |
| 2023/0249870 | A1* | 8/2023 | Huang | B65D 5/38 229/125.125 |
| 2023/0264852 | A1* | 8/2023 | Hoefte | B65D 5/38 206/1.5 |
| 2023/0264853 | A1* | 8/2023 | Hoefte | B65D 5/566 229/125.26 |
| 2023/0286695 | A1* | 9/2023 | Hoefte | B65D 5/38 |
| 2023/0415950 | A1 | 12/2023 | Mack et al. | |
| 2024/0025607 | A1* | 1/2024 | Bressan | B65D 5/542 |
| 2024/0327063 | A1* | 10/2024 | Bressan | B65D 5/685 |
| 2025/0100763 | A1* | 3/2025 | Spahlinger | B65D 50/066 |

FOREIGN PATENT DOCUMENTS

| | | | |
|---|---|---|---|
| CH | 534616 | | 3/1973 |
| CH | 681293 | | 2/1993 |
| CH | 710519 | A2 | 6/2016 |
| CN | 105209590 | | 12/2015 |
| CN | 109071064 | | 12/2018 |
| CN | 112498895 | A | 3/2021 |
| DE | 9214914 | U1 | 1/1993 |
| DE | 202020106481 | | 2/2022 |
| DE | 102020129814 | | 5/2022 |
| EP | 0571711 | A2 | 12/1993 |
| EP | 0679581 | | 11/1995 |
| EP | 1783058 | A1 | 5/2007 |
| EP | 1783058 | | 4/2010 |
| EP | 2594507 | A1 | 5/2013 |
| EP | 2512938 | B1 | 6/2017 |
| EP | 3261941 | | 1/2018 |
| EP | 3587293 | A1 | 1/2020 |
| EP | 3623308 | A1 | 3/2020 |
| EP | 3753856 | A1 | 12/2020 |
| EP | 3 871 989 | | 9/2021 |
| EP | 3871989 | A1 | 9/2021 |
| EP | 3978380 | | 4/2022 |
| EP | 4039606 | A1 * | 8/2022 ..... B65D 5/566 |
| EP | 4163219 | | 4/2023 |
| EP | 4245676 | | 9/2023 |
| EP | 4269264 | | 11/2023 |
| FR | 2820718 | A1 | 8/2002 |
| GB | 385033 | | 12/1932 |
| GB | 2256425 | A | 12/1992 |
| GB | 2358391 | | 7/2001 |
| JP | 52022499 | Y2 | 5/1977 |
| JP | S5222499 | | 5/1977 |
| JP | S54142223 | | 10/1979 |
| JP | H03639 | | 1/1991 |
| JP | H11049151 | A | 2/1999 |
| JP | 2002029536 | A | 1/2002 |
| JP | 2002145256 | A | 5/2002 |
| JP | 2009161222 | A | 7/2009 |
| JP | 4536881 | B2 | 9/2010 |
| JP | 2011140318 | A | 7/2011 |
| JP | 2011173640 | A | 9/2011 |
| JP | 2011189978 | A | 9/2011 |
| JP | 2013531589 | | 8/2013 |
| JP | 2017007691 | A | 1/2017 |
| JP | 2017131364 | | 8/2017 |
| JP | 2017171364 | A | 9/2017 |
| JP | 2018009176 | | 1/2018 |
| JP | 6298245 | B2 | 3/2018 |
| JP | 2018076095 | A | 5/2018 |
| JP | 3216684 | | 6/2018 |
| KR | 200310542 | Y1 | 4/2003 |
| KR | 100906301 | B1 | 7/2009 |
| NL | 100017 | | 12/1961 |
| TW | 201444743 | A | 12/2014 |
| WO | 03101840 | A1 | 12/2003 |
| WO | 2008038189 | | 4/2008 |
| WO | 2008054305 | A1 | 5/2008 |
| WO | 2010015638 | | 2/2010 |
| WO | 2010085471 | | 7/2010 |
| WO | 2011012863 | A1 | 2/2011 |
| WO | 2011154822 | | 12/2011 |
| WO | 2013076012 | A1 | 5/2013 |
| WO | 2018022493 | A1 | 2/2018 |
| WO | 2019094406 | A1 | 5/2019 |
| WO | 2019236830 | A1 | 12/2019 |
| WO | 2020052911 | A1 | 3/2020 |
| WO | 2021013515 | | 1/2021 |
| WO | 2021044266 | A1 | 3/2021 |
| WO | 2022101339 | A1 | 5/2022 |
| WO | 2023150283 | A1 | 8/2023 |
| WO | 2024049779 | A1 | 3/2024 |

OTHER PUBLICATIONS

U.S. Appl. No. 18/728,966, filed Jul. 15, 2024.
U.S. Appl. No. 18/218,757, filed Jul. 6, 2023.
U.S. Appl. No. 18/220,881, filed Jul. 12, 2023.
U.S. Appl. No. 19/084,935, filed Mar. 20, 2025.
U.S. Appl. No. 19/084,943, filed Mar. 20, 2025.
International Search Report and Written Opinion for PCT/US2023/031328 dated Dec. 13, 2023.
International Search Report and Written Opinion for PCT/US2023/026994 dated Oct. 26, 2023, 11 pages.
International Search Report and Written Opinion for PCT/US2023/027438 dated Nov. 7, 2023.
12×12×6" Kraft Tab Locking Literature Mailers S-16934—Uline. Date first available: Dec. 1, 2020. Site visited: Mar. 4, 2025. Available online: https://www.uline.com/Product/Detail/S-16934/Indestructo-and-Literature-Mailers/12-x-12-x-6- Kraft-Tab-Locking-Literature-Mailers, Year: 2020, (pp. 1-1).
Custom Corrugated Boxes | Flip Top Storage Box | CustomBoxline. Date first available: Sep. 22, 2021. Site visited: Mar. 4, 2025. Available online: https://www.customboxline.com/producUcustom-corrugated-boxes-flip-top-storage-box, Year: 2021, (pp. 1-6).

(56) References Cited

OTHER PUBLICATIONS

Strength Packaging | Graphic Packaging International. Date first available: Mar. 31, 2024. Site visited: Mar. 4, 2025. Available online: https://www.graphicpkg.com/solutions/packaging-solutions/strength-packaging/, Year: 2024, (pp. 1-10).

* cited by examiner

CARTON WITH LOCKING FEATURES

CROSS-REFERENCE TO RELATED APPLICATIONS

This application claims the benefit of German Utility Model Application No. 202022104856.8, filed on Aug. 29, 2022.

INCORPORATION BY REFERENCE

The disclosure of German Utility Model Application No. 202022104856.8, which was filed on Aug. 29, 2022, is hereby incorporated by reference for all purposes as if presented herein in its entirety.

BACKGROUND OF THE DISCLOSURE

The present disclosure generally relates to cartons/boxes for holding one or more products. More specifically, the present disclosure relates to a carton with an inner construct at least partially received within an outer construct and with locking features for selectively limiting and/or resisting relative movement between the constructs of the carton.

Cartons/boxes with locking features can be used for a wide variety of different products, such as dishwashing agents, medicines, household cleaners, candles, cosmetics, tobacco, and other products that should be kept out of the hands of children, as they may put the products in their mouths, swallow them, or use them in other dangerous ways. In examples, one may want to keep certain products out of the reach of infants, toddlers, kindergarten children, and children of preschool age, i.e., up to about the age of six, for example.

SUMMARY OF THE DISCLOSURE

In general, one aspect of the disclosure is directed to a carton, the carton comprising an inner construct comprising a plurality of inner panels extending at least partially around a first interior of the inner construct. The inner construct comprises an inner locking tab foldably connected to at least one inner panel of the plurality of inner panels and an inner locking flap foldably connected to the at least one inner panel of the plurality of inner panels. An outer construct comprises a plurality of outer panels extending at least partially around a second interior of the outer construct. The inner construct is for being at least partially received in the second interior of the outer construct and positionable to a locked position wherein movement of the inner construct relative to the outer construct is restricted. The outer construct comprises an outer locking tab foldably connected to at least one outer panel of the plurality of outer panels, and the inner locking tab and the inner locking flap cooperate with the outer locking tab to limit movement between the inner construct and the outer construct at the locked position. An engagement feature extends in the at least one outer panel of the outer construct. The engagement feature comprises an engagement hole in the at least one outer panel. At least one of the inner locking tab and the inner locking flap of the inner construct are adjacent the engagement feature in the outer construct at the locked position so that the at least one of the inner locking tab and the inner locking is positioned for disengagement with the outer locking tab via the engagement hole for facilitating movement of the inner construct and the outer construct relative to one another from the locked position to an open position wherein the first interior of the inner construct is accessible. The inner locking flap is moveable relative to the at least one inner panel to create an audible locking sound upon positioning the inner construct to the locked position.

In another aspect, the disclosure is generally directed to, in combination, a first blank and a second blank for cooperating to at least partially form a carton. The first blank comprises a plurality of inner panels, an inner locking tab foldably connected to at least one inner panel of the plurality of inner panels, and an inner locking flap foldably connected to the at least one inner panel of the plurality of inner panels. The first blank is for forming an inner construct. The second blank comprises a plurality of outer panels and an outer locking tab foldably connected to at least one outer panel of the plurality of outer panels. The second blank is for forming an outer construct for at least partially receiving the inner construct formed from the first blank when the carton is formed from the first blank and the second blank. The inner locking tab and the inner locking flap cooperate with the outer locking tab to limit movement between the inner construct formed from the first blank and the outer construct formed from the second blank in a locked position of the carton formed from the first blank and the second blank. An engagement feature extends in the at least one outer panel of the second blank. The engagement feature comprises an engagement hole in the at least one outer panel. The engagement feature is for accessing at least one of the inner locking tab and the inner locking flap for disengagement with the outer locking tab via the engagement hole for facilitating movement of the inner construct and the outer construct relative to one another from the locked position to an open position of the carton formed from the first blank and the second blank. The inner locking flap is moveable relative to the at least one inner panel to create an audible locking sound upon positioning the inner construct to locked position in the carton formed from the first blank and the second blank.

In another aspect, the disclosure is generally directed to a method of forming a carton. The method can include obtaining a first blank comprising a plurality of inner panels, an inner locking tab foldably connected to at least one inner panel of the plurality of inner panels, and an inner locking flap foldably connected to the at least one inner panel of the plurality of inner panels. The method comprises forming an inner construct from the first blank by folding the plurality of inner panels at least partially around a first interior of the inner construct. The method includes obtaining a second blank comprising a plurality of outer panels and an outer locking tab foldably connected to at least one outer panel of the plurality of outer panels, and an engagement feature extending in the at least one outer panel. The engagement feature comprising an engagement hole in the at least one outer panel. The method comprises forming an outer construct from the second blank by folding the plurality of outer panels at least partially around a second interior of the outer construct. The method comprises moving at least one of the inner construct and the outer construct relative to the other to assemble the carton with the inner construct at least partially received in the second interior of the outer construct and in a locked position, wherein the inner locking tab and the inner locking flap cooperate with the outer locking tab to limit movement between the inner construct and the outer construct at the locked position. At least one of the inner locking tab and the inner locking flap is accessible via the engagement hole for disengagement with the outer locking tab for facilitating movement of the inner construct and the outer construct relative to one another from the locked position to an open position. The moving the at least one of the inner construct and the outer construct relative to each other comprises the inner locking flap moving relative to the at least one inner panel to create an audible locking sound when the inner construct is moved to the locked position.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to constructs, boxes, cartons, carriers, trays, or the like, and packages for holding one or more products or articles such as those that should be kept out of the hands of children (e.g., for safety reasons). The product or products can be cleaning products such as dishwashing agents, household cleaners, soaps, and the like; medicines; cosmetics; candles; tobacco; objects that may pose a choking hazard; any other suitable product or material; or combinations thereof.

Constructs according to the present disclosure can accommodate product or articles of any shape. In this specification, the terms "inner," "interior," "outer," "exterior," "lower," "bottom," "upper," and "top" indicate orientations determined in relation to fully erected and upright constructs and cartons. As described herein, constructs can be formed from blanks by being glued with multiple panels, portions, tabs, and/or flaps, which may be designated herein in terms relative to one another, e.g., "first", "second", "third", etc., in sequential or nonsequential reference, without departing from the disclosure.

Figure 1:
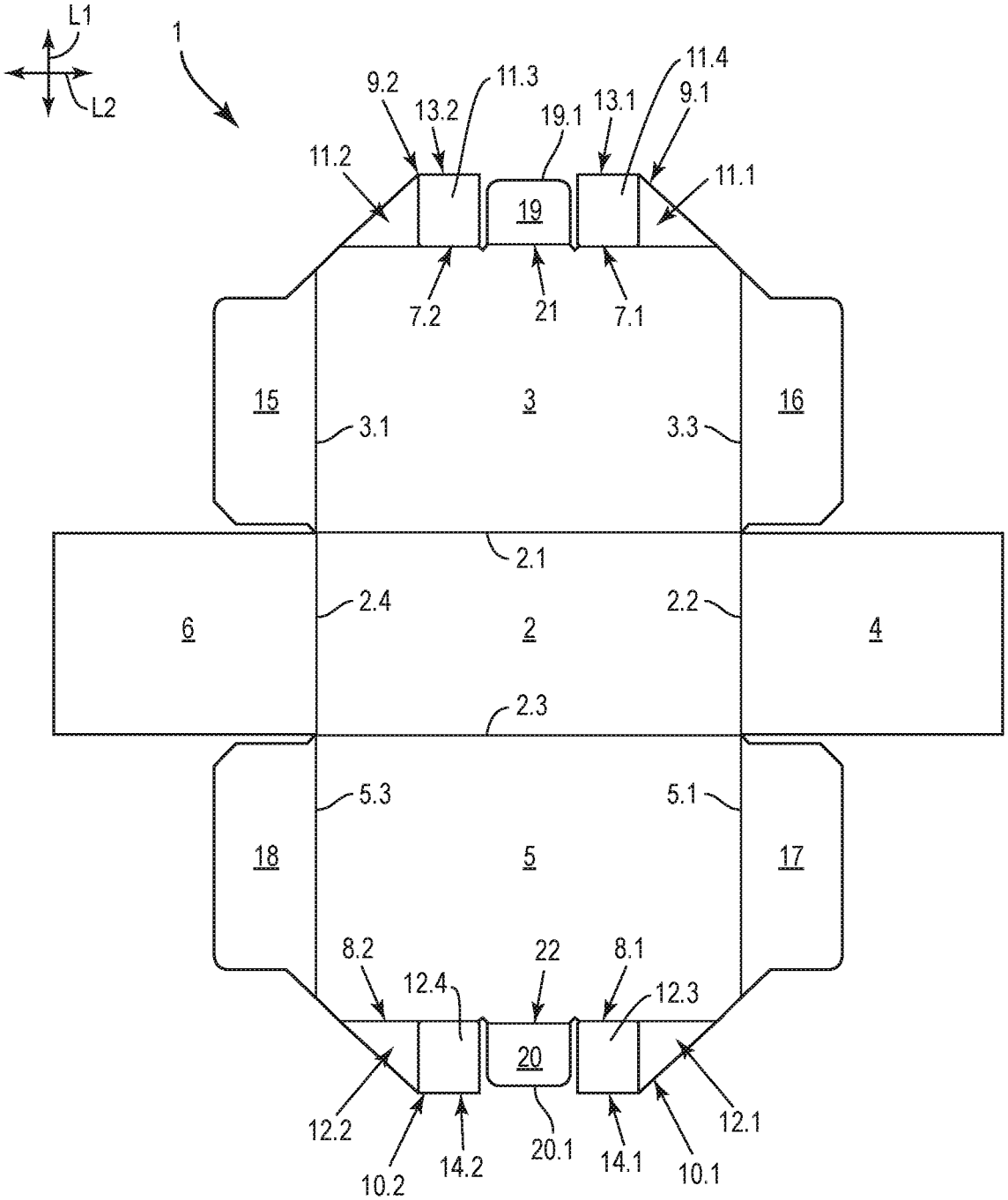
FIG. 1 is a plan view of a first blank for forming an inner construct according to exemplary embodiments of the disclosure.
Figure 4:
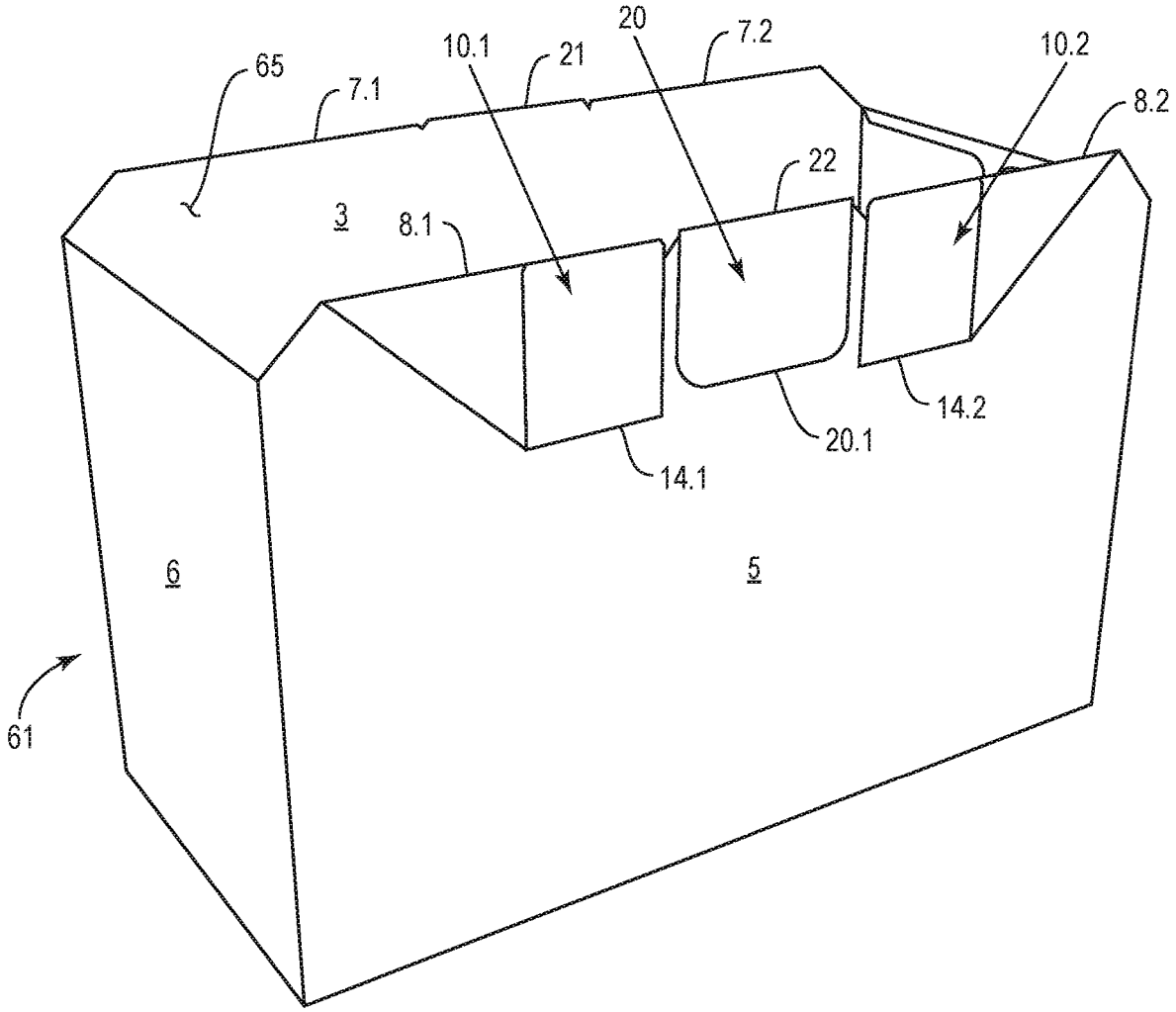
FIG. 4 is a perspective view of the inner construct.
Figure 5:
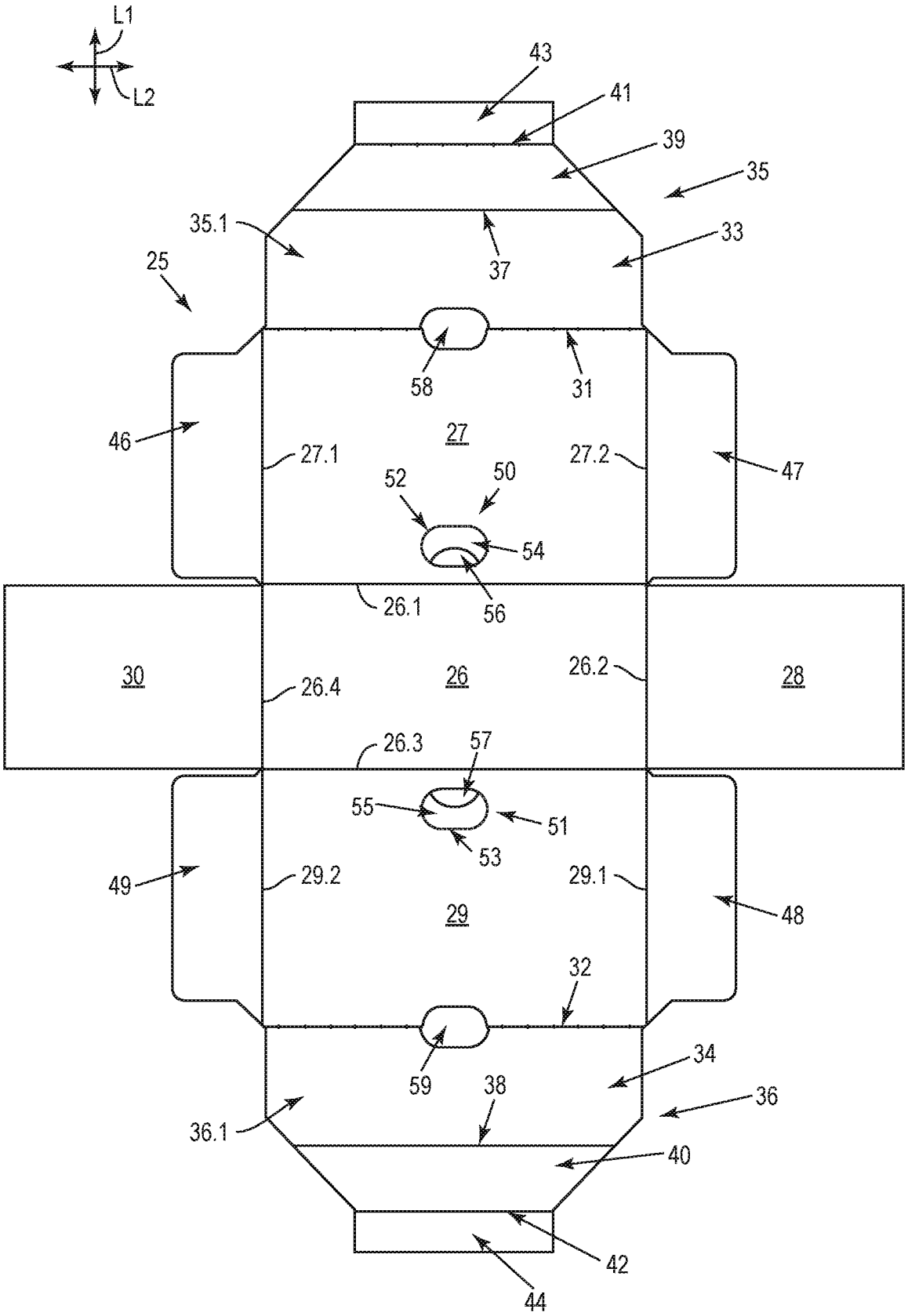
FIG. 5 is a plan view of a second blank for forming an outer construct according to exemplary embodiments of the disclosure.

According to FIG. 1, a first blank 1 is used to form an inner part or inner construct 61 (FIGS. 3-8) with a first opening 65 according to exemplary embodiments of the disclosure. The inner construct 61 can be a container used to hold one or more products (not shown). FIG. 5 illustrates a second blank 25 used to form an outer part or outer construct 60 (e.g., a cover 60) (FIGS. 6-8) with a second opening 62 according to exemplary embodiments of the disclosure. In embodiments, the inner (interior) construct 61 and the outer (exterior) construct 60 cooperate to form a carton 68 (FIG. 8) with the outer construct 60 extending at least partially around the inner construct 61 and the inner construct being selectively movable within the outer construct between a closed/locked configuration or first position (FIG. 8) and an open configuration or second position (FIG. 6), as described in more detail below. In the illustrated embodiments, the inner construct 61 and the outer construct 60 can include locking features for cooperating to resist and/or limit movement of the inner construct 61 relative to the outer construct 60, as described in more detail below. Further, the inner construct 61 and/or the outer construct 60 can include audible features that indicate when the inner construct is in the closed/locked position of the carton 68, as described in more detail below. In exemplary embodiments, the blanks 1, 25 can be made of paperboard, cardboard, corrugated cardboard, or other suitable material.

As shown in FIG. 1, the first blank 1 has a longitudinal direction L1 and a lateral direction L2. In the illustrated embodiment, the first blank 1 can have a bottom wall or panel 2 that is foldably connected at its edges to four first side walls or inner panels 3, 4, 5, 6 along respective fold lines 2.1, 2.2, 2.3, 2.4. For example, the bottom panel 2 can be foldably connected to the respective first inner side panel 3 and second inner side panel 5 along respective lateral fold lines 2.1, 2.3, and the bottom panel 2 can be foldably connected to the respective first inner end panel 4 and second inner end panel 6 along respective longitudinal fold lines 2.2, 2.4. As shown in FIG. 1, at least the bottom panel 2 and the inner end panels 4, 6 can be rectangular. Any of the bottom panel 2 and/or the inner panels 3, 4, 5, 6 could be omitted or could be otherwise shaped, arranged, and/or configured without departing from the disclosure.

In the illustrated embodiments, the inner side panel 3 can be foldably connected to first or inner locking tabs 9.1, 9.2 at respective lateral fold lines 7.1, 7.2. Similarly, the inner side panel 5 can be foldably connected to first or inner locking tabs 10.1, 10.2 at respective lateral fold lines 8.1, 8.2. As shown in FIG. 1, each of the inner locking tabs 9.1, 9.2 can include a respective first/triangular portion 11.1, 11.2 and a respective second/rectangular portion 11.3, 11.4, and each of the inner locking tabs 10.1, 10.2 can include a respective first/triangular portion 12.1, 12.2 and a respective second/rectangular portion 12.3, 12.4. In the illustrated embodiment, the second portions 11.3, 11.4, of the locking tabs 9.1, 9.2 have locking edges 13.1, 13.2 spaced apart from the fold lines 7.1, 7.2. In the illustrated embodiment, the second portions 12.3, 12.4 of the inner locking tabs 10.1, 10.2 have locking edges 14.1, 14.2 spaced apart from the fold lines 8.1, 8.2. The portions 11.1, 11.2, 11.3, 11.4, 12.1, 12.2, 12.3, 12.4 of the inner locking tabs 9.1, 9.2, 10.1, 10.2 could have alternative sizes and shapes as to the sizes and shaped shown and/or described herein without departing from the scope of the disclosure.

As shown in FIG. 1, the first inner side panel 3 is foldably connected to an inner locking flap 19 at a lateral fold line 21 and the inner side panel 5 is foldably connected to an inner locking flap 20 at a lateral fold line 22. In one embodiment, the inner locking flap 19 is spaced apart from the adjacent inner locking tabs 9.1, 9.2. and the inner locking flap 20 is spaced apart from the adjacent inner locking tabs 10.1, 10.2. In the illustrated embodiment, the inner locking flap 19 has a distal edge 19.1 that is spaced apart from the fold line 21 by a smaller distance than the locking edges 13.1, 13.2 are spaced apart from the respective fold lines 7.1, 7.2. As such, the locking flap 19 extends from the inner side panel 3 a smaller distance than the inner locking tabs 9.1, 9.2. Similarly, the inner locking flap 20 has a distal edge 20.1 that is spaced apart from the fold line 22 by a smaller distance than the locking edges 14.1, 14.2 are spaced apart from the respective fold lines 8.1, 8.2, and the inner locking flap 20 extends from the inner side panel 5 a smaller distance than the inner locking tabs 10.1, 10.2. The inner locking flaps 19, 20, could be otherwise shaped, arranged, and/or positioned without departing from the disclosure.

As shown in FIG. 1, the first inner side panel 3 is foldably connected to respective inner dust flaps or inner side end flaps 15, 16 along respective longitudinal fold lines 3.1, 3.3. Similarly, the second inner side panel 5 is foldably connected to respective inner dust flaps or inner side end flaps 17, 18 along respective longitudinal fold lines 5.1, 5.3. In embodiments, the longitudinal fold lines 3.1, 3.3 and 5.1, 5.3 can extend along rectangular sections of the respective inner side panels 3, 5. Any of the inner locking tabs 9.1, 9.2, 10.1, 10.2, inner locking flaps 19, 20, the inner side end flaps 15, 16, 17, 18, and/or the inner side panels 3, 5 could be omitted or could be otherwise shaped, arranged, and/or configured without departing from the disclosure.

The blank 1 could be otherwise shaped, arranged, and/or configured without departing from the disclosure.

Figure 2:
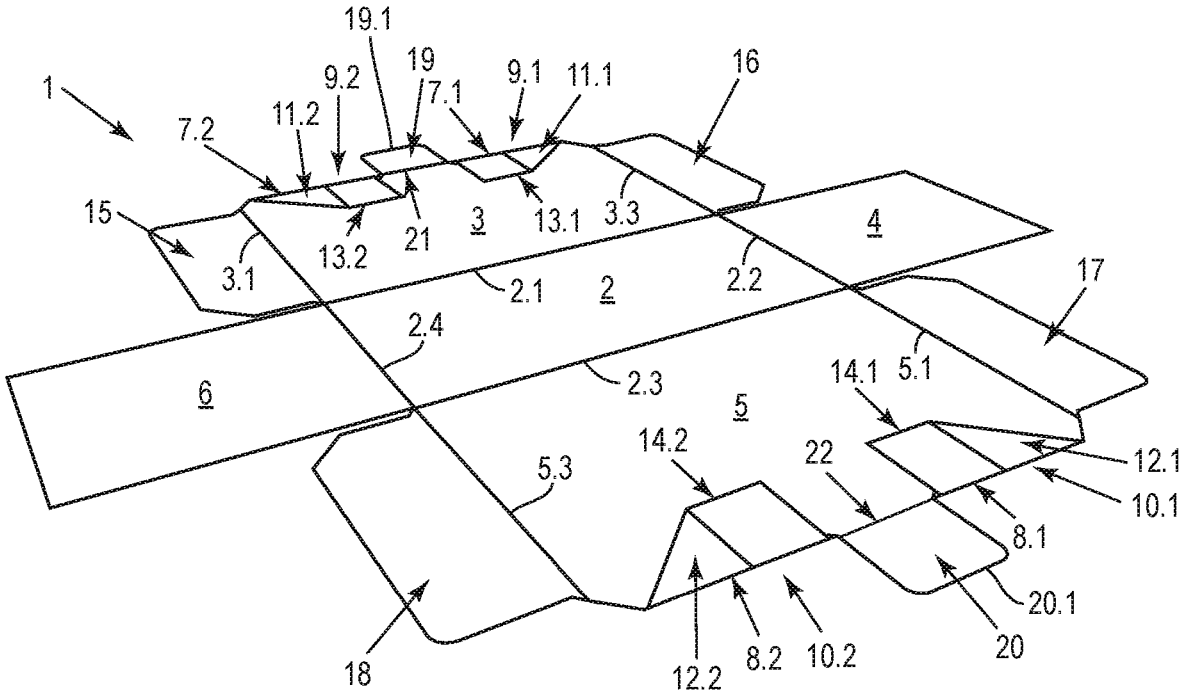
FIG. 2 is a perspective view of the first blank partially folded to form the inner construct.

In a first processing step for forming the inner construct 61 from the first blank 1, the inner locking tabs 9.1, 9.2, 10.1, 10.2 can be folded against and secured (e.g., adhesively attached) to the outer sides of the respective inner side panels 3, 5 (FIG. 2). In exemplary embodiments, the inner locking tabs 9.1, 9.2, 10.1, 10.2 can be folded and glued to the respective inner side panels 3, 5 (e.g., by a manufacturer of the packaging) and then stored and/or transported (e.g., to a packer) in a flat, glued blank configuration (not shown), such as in stacks with other similar or identical blanks.

Figure 3:
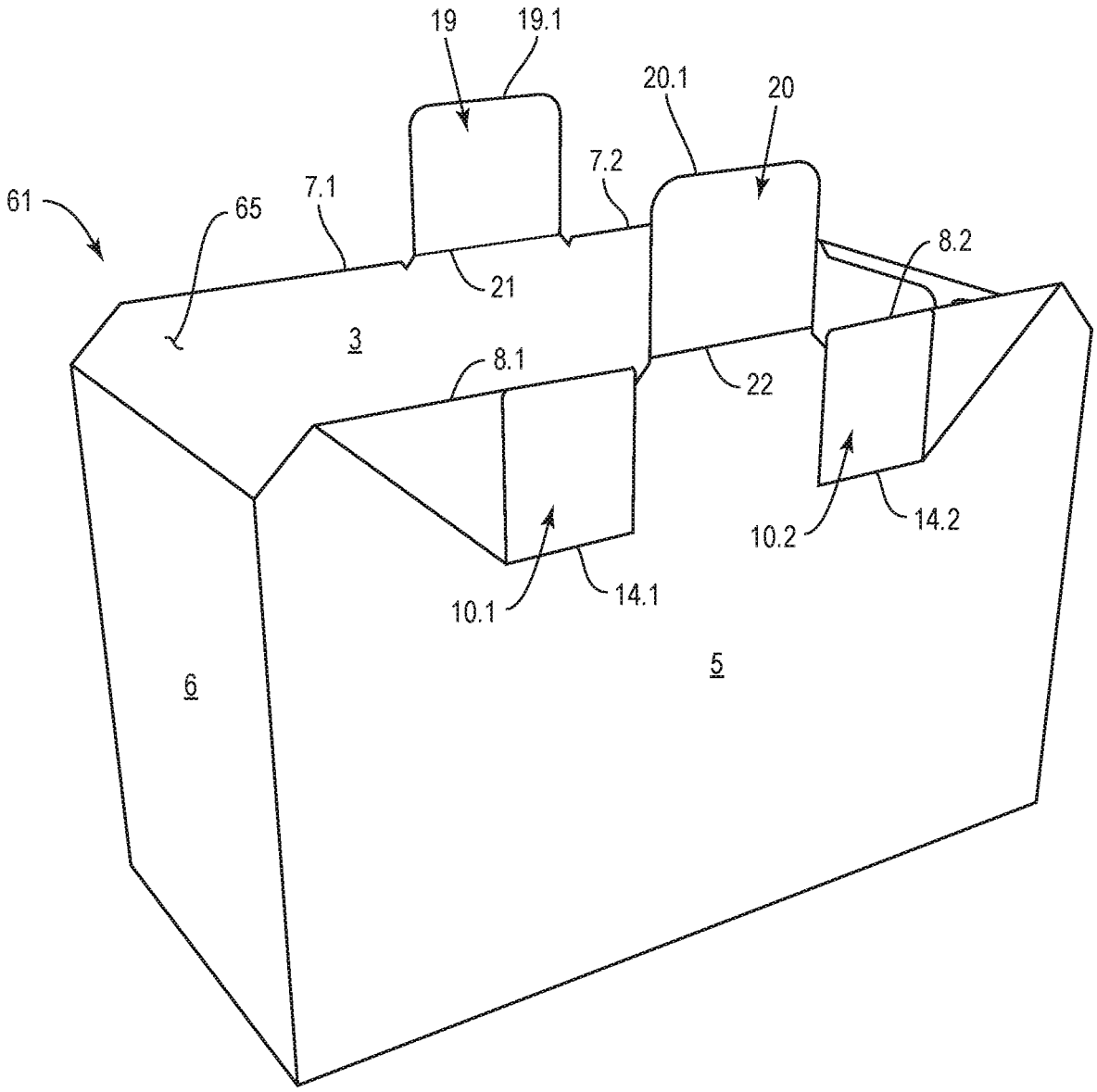
FIG. 3 is a perspective view of the partially formed inner construct.

As shown in FIGS. 3 an 4, the erected inner construct 61 can be formed from the flat, glued blank 1 (e.g., by a folder-gluer system, a packer, etc.) by folding the inner side panels 3, 5 along the lateral fold lines 2.1, 2.3 to extend upwardly from the bottom panel 2, folding the inner end flaps 15, 18 and 16, 17, along the respective longitudinal fold lines 3.1, 5.3 and 3.3, 5.1 over the respective ends of the inner construct 61, and folding the inner end panels 6, 4 along the respective longitudinal fold lines 2.4, 2.2 over the respective ends of the inner construct 61. In the illustrated embodiments, the inner side end flaps 15, 16, 17, 18 can be folded to extend between the inner side panels 3, 5, perpendicular to the inner side panels 3, 5. In embodiments, the first inner end panel 4 can overlap and can be secured (e.g., adhered) to the inner side end flaps 16, 17 to form a first inner end wall, and the second inner end panel 6 can overlap and can be secured (e.g., adhered) to the inner side end flaps 15, 18 to form a second inner end wall. In the illustrated embodiment, the bottom panel 2, the inner panels 3, 4, 5, 6, and the inner end flaps 15, 16, 17, 18 can extend at least partially around a first interior of the inner construct 61 for receiving items in the inner construct 61. In the illustrated embodiments, the erected inner construct 61 can have a first or inner opening 65 defined between the inner panels 3, 4, 5, 6 in relation to the bottom panel 2 (e.g., for inserting products into and removing products from the inner construct 17). As shown in FIG. 4, the folded inner locking tabs 9.1, 9.2, 10.1, 10.2 have the locking edges 13.1, 13.2, 14.1, 14.2 spaced downward from the respective top edges of the respective inner side panels 3, 5. In the illustrated embodiments, the locking edges 13.1, 13.2, 14.1, 14.2 can face away from the inner opening 65 and toward the bottom panel 2 and can be spaced apart from the inner opening 65 and the bottom panel 2. As shown in FIG. 3, the inner locking flaps 19, 20 can be downwardly folded at respective fold lines 21, 22 to be adjacent a respective inner side panel 3, 5. In one embodiment, the inner locking flaps 19, 20 are free from attachment to the outer surface of the inner side panels so that the inner locking flaps are free to move relative to the inner side panels. The inner locking flap 19 is adjacent and spaced apart from each of the inner locking tabs 9.1, 9.2 and the inner locking flap 20 is adjacent and spaced apart from each of the inner locking tabs 10.1, 10.2. As shown in FIG. 4, the distal edges 19.1, 20.1 of the locking flaps 19, 20 are closer to the respective top edges of the respective inner side panels 3, 5 that the locking edges 13.1, 13.2, 14.1, 14.2 of the folded and attached inner locking tabs 9.1, 9.2, 10.1, 10.2.

The inner construct 61 could be otherwise formed without departing from the disclosure.

As shown in FIG. 5, the second blank 25 for the outer part/construct 60 can have a longitudinal direction L1 and a lateral direction L2. In the illustrated embodiment, the second blank 25 can include a top wall or panel 26 that is foldably connected at its edges to four second side walls or outer panels 27, 28, 29, 30 along respective fold lines 26.1, 26.2, 26.3, 26.4. For example, the top panel 26 can be foldably connected to the respective first outer side panel 27 and second outer side panel 29 along respective lateral fold lines 26.1, 26.3, and the top panel 26 can be foldably connected to the respective first outer end panel 28 and second outer end panel 30 along respective longitudinal fold lines 26.2, 26.4. In embodiments, each of the top wall 26 and the outer panels 27, 28, 29, 30 can be rectangular. Any of the top panel 26 and/or the outer panels 27, 28, 29, 30 could be omitted or could be otherwise shaped, arranged, and/or configured without departing from the disclosure.

In the illustrated embodiments, the first outer side panel 27 can be foldably connected to respective outer dust flaps or outer side end flaps 46, 47 along respective longitudinal fold lines 27.1, 27.2. Similarly, the second outer side panel 29 can be foldably connected to respective outer dust flaps or outer side end flaps 48, 49 along respective longitudinal fold lines 29.1, 29.2. Any of the outer side end flaps 46, 47, 48, 49 and/or the outer side panels 27, 29 could be omitted or could be otherwise shaped, arranged, and/or configured without departing from the disclosure.

As shown in FIG. 5, the outer side panels 27, 29 can be foldably connected to respective second or outer locking tabs 35, 36 along respective lateral fold lines 31, 32 at opposing edges of the outer side panels 27, 29. In the illustrated embodiments, each of the outer locking tabs 35, 36 can include a respective proximal section 35.1, 36.1 (e.g., an outer or second proximal section) and a respective distal section 43, 44 (e.g., an outer or second distal section). In embodiments, the proximal sections 35.1, 36.1 are foldably connected (e.g., directly foldably connected) to the respective outer side panels 27, 29 along the respective lateral fold lines 31, 32 and are foldably connected to the respective distal sections 43, 44 along respective lateral fold lines 41, 42, which are opposite to the respective lateral fold lines 31, 32. In exemplary embodiments, each of the proximal sections 35.1, 36.1 can have two portions, wherein a respective first portion 33, 34 adjoins a respective lateral fold line 31, 32 and can be rectangular (e.g., can be defined by 0 free edges extending in the longitudinal direction L1). In embodiments, the second portions 39, 40 adjoin the respective lateral fold lines 41, 42 and are trapezoidal (e.g., can be defined by free edges that are oblique), wherein the respective second portions 39, 40 widen toward the respective first portions 33, 34. In exemplary embodiments, the distal sections 43, 44 can be rectangular and can be foldably connected to the short edges of the proximal sections 35.1, 36.1 along the lateral fold lines 41, 42. Alternatively, the sections 35.1, 43, 36.1, 44 could have any suitable shape.

In the illustrated embodiments, the second blank 25 can include engagement devices or features 50, 51 extending in the respective outer side panels 27, 29. As shown in FIG. 5, the engagement devices 50, 51 can be positioned closer to the top panel 26 than to the respective outer locking tabs 35, 36 and can have an oval shape. In embodiments, the engagement devices 50, 51 can include respective weakening lines 52, 53 (e.g., cut or tear lines) that at least partially define respective engagement covers or cover panels 54, 55. In exemplary embodiments, the weakening lines 52, 53 can be formed by mutually offset scribe lines in the outer surfaces and inner surfaces of the outer side panels 27, 29, tear lines, cut lines, or any suitable lines of weakening. As shown in FIG. 5, the engagement devices 50, 51 can include respective access openings 56, 57 (e.g., having a lens shape) extending along an edge of the respective weakening lines 52, 53 (e.g., proximate to the top panel 26). Alternatively, the access openings 56, 57 could be positioned along any portion of the respective cover panels 54, 55 or could be omitted. In embodiments, the covers 54, 55 can be removed by tearing along the weakening lines 52, 53 to form respective engagement holes 51.1, 51.2 in the respective outer side panels 27, 29. In some embodiments, the engagement devices 50, 51 can include fold lines (not shown), wherein the respective weakening lines 52, 53 extend from the ends of the respective fold lines, so that the covers 54, 55 are partially removed from the respective outer panels 27, 29 along the respective weakening lines 52, 53 and folded outwardly along the respective fold lines (not shown). Alternatively, the cover panels 54, 55 could be removed from the blank 25 exposing the engagement openings 50.1, 51.1 prior to forming the outer construct 60 from the second blank, or the cover panels 54, 55 can be eliminated and not included in the blank 25.

As shown in FIG. 5, the second blank 25 further can include engagement openings 58, 59 (e.g., in the shape of an oval). In embodiments, the opening 58 can extend in the first outer side panel 27 and the proximal portion 35.1 of the first outer locking tab 35 (e.g., with half in the outer side panel 27 and half in the proximal portion 35.1 arranged symmetrically with respect to the lateral fold line 31). Further, the engagement opening 59 extends in the second outer side panel 29 and the proximal portion 36.1 of the second outer locking tab 36 (e.g., with half in the outer side panel 29 and half in the proximal portion 36.1 arranged symmetrically with respect to the lateral fold line 32). Any of the engagement features 50, 51, 58, 59 could be omitted or could be otherwise shaped, arranged, and/or configured without departing from the disclosure. For example, the engagement features could have any suitable shape. In another example, the covers 54, 55 could be omitted so that the engagement features 50, 51 are openings 50.1, 51.1 in the outer side panels 27, 29. Further, at least partially removable panels (not shown) (e.g., similar to the cover panels 54, 55) can be included in the blank 25 and can be removed by tearing along weakening lines (not shown) (e.g., similar to the weakening lines 52, 53) to form the engagement openings 58, 59.

The blank 25 could be otherwise shaped, arranged, and/or configured without departing from the disclosure.

Figure 6:
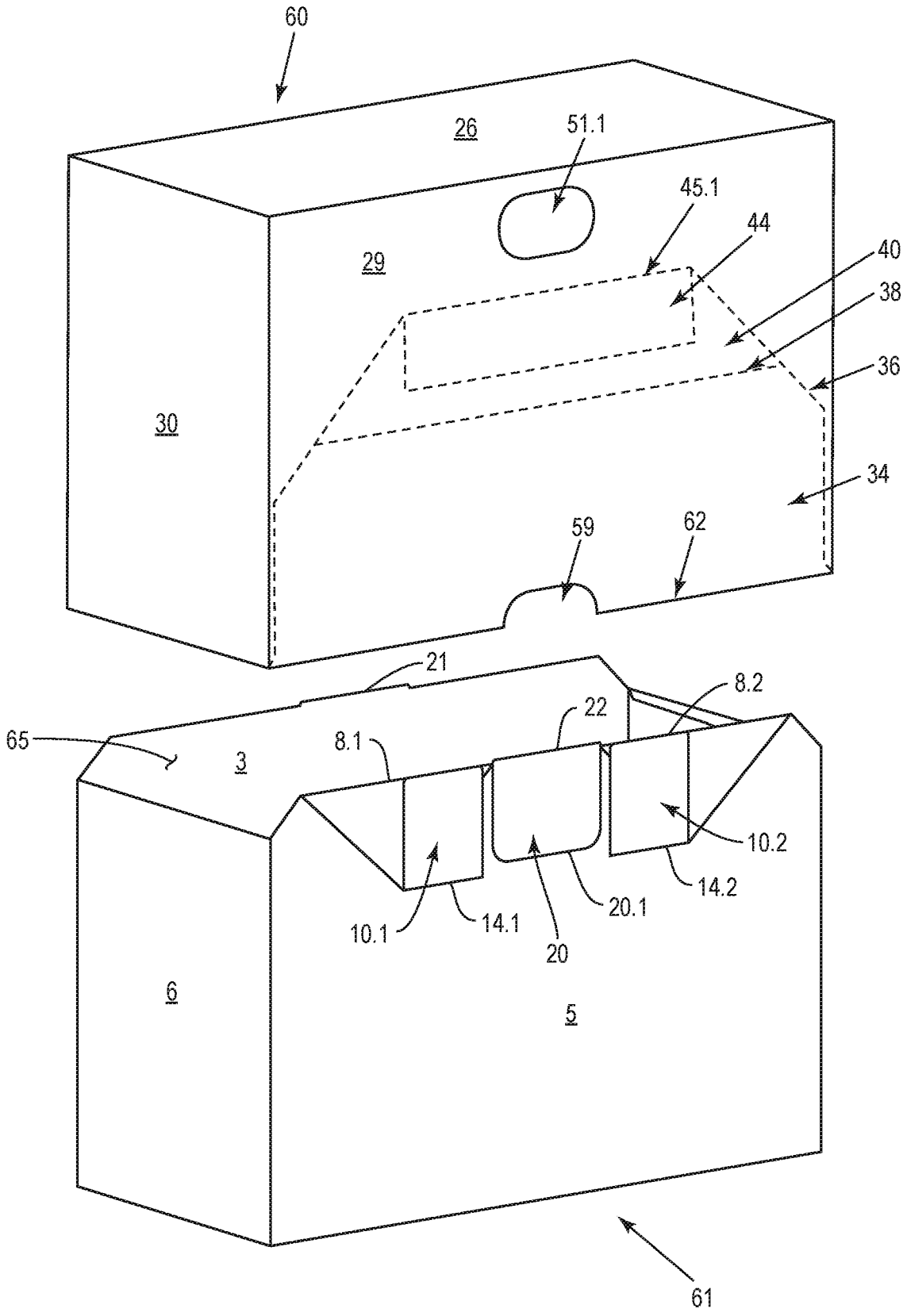
FIG. 6 is a perspective view of the inner construct and the outer construct arranged relative to one another for moving the outer construct onto the inner construct and/or after removing the inner construct from the outer construct according to exemplary embodiments of the disclosure.
Figure 7:
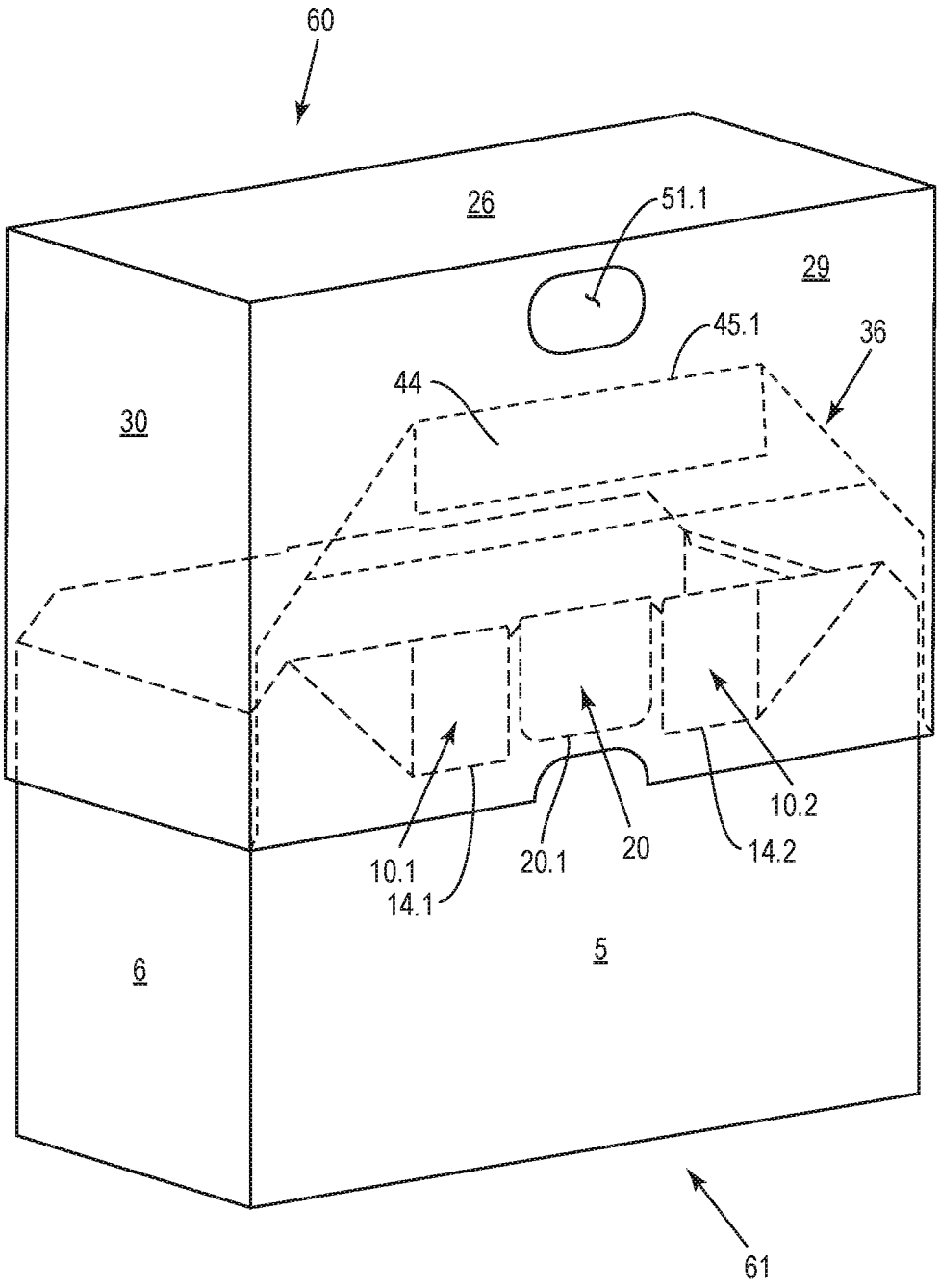
FIG. 7 is a perspective view of the inner construct partially received in the outer construct as arranged showing the hidden features of the inner construct and the outer construct in broken lines according to exemplary embodiments of the disclosure.
Figure 8:
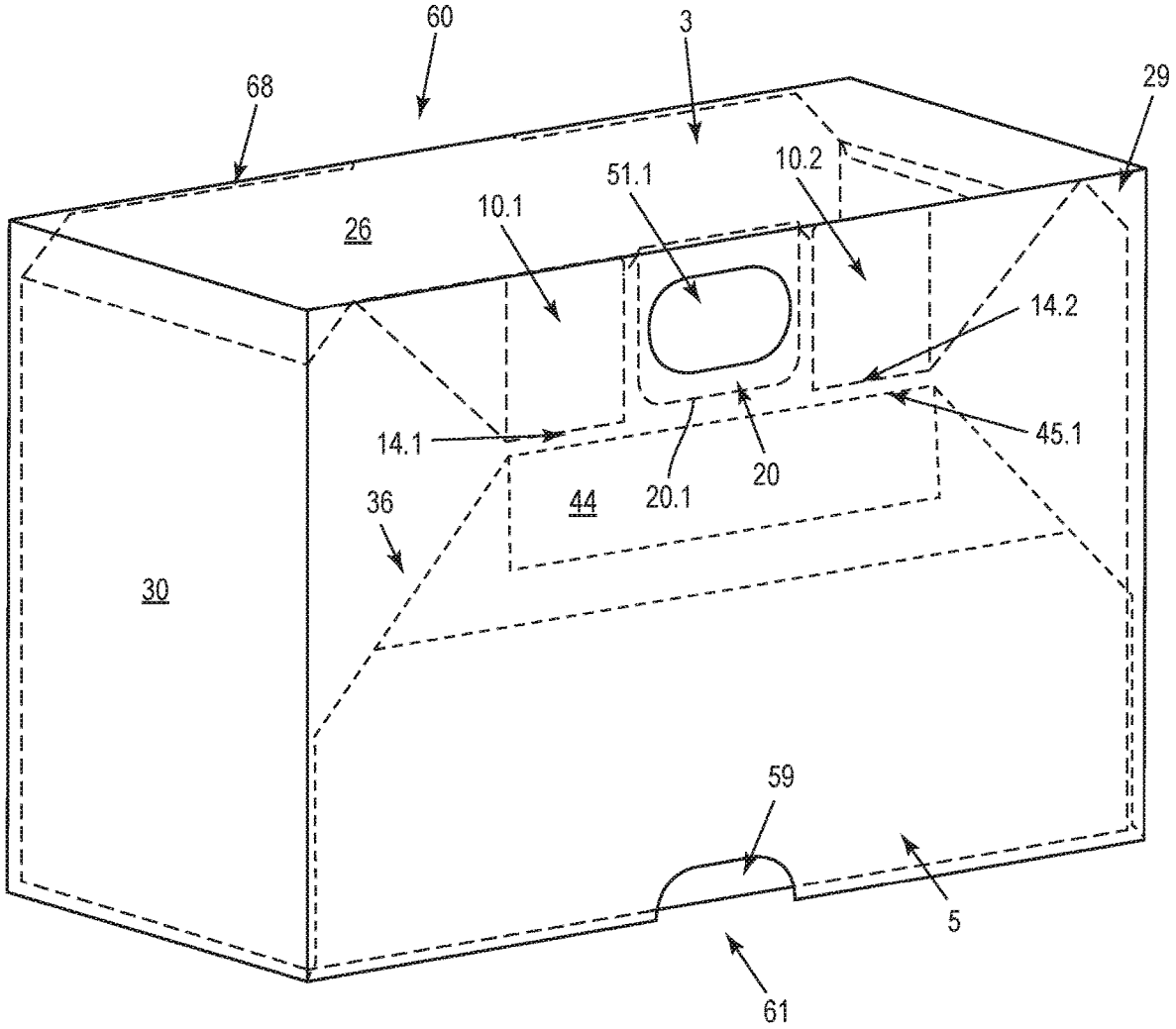
FIG. 8 is a perspective view of the carton formed by assembling the inner construct and the outer construct showing the engaged locking tabs of the constructs in broken lines according to exemplary embodiments of the disclosure.

In a first processing step for forming the outer construct 60 (FIG. 6) from the second blank 25, the distal sections 43, 44 of the outer locking tabs 35, 36 can be folded against and secured (e.g., adhesively bonded) to the inner sides of the respective proximal sections 35.1, 36.1 of the outer locking tabs 35, 36. Further, the outer proximal sections 35.1, 36.1 can be folded against the inner sides of the respective outer side panels 27, 29 and the distal sections 43, 44 can be secured (e.g., adhesively bonded) to the inner sides of the outer side panels 27, 29. Accordingly, the distal sections 43, 44 can be secured between the respective proximal portions 35.1, 36.1 and the respective outer side panels 27, 29. Alternatively, the proximal portions 33.1, 34.1 can be disposed between the respective outer side panels 27, 29 and the respective distal sections 43, 44 and secured to the outer side panels 27, 29. In the illustrated embodiments, the folded outer locking tabs 35, 36 can form second or outer locking edges 45.1, 45.2 along the respective lateral fold lines 41, 42 and positioned between the engagement devices 50, 51 and the respective lateral fold lines 31, 32 (FIGS. 6-8). As shown in FIGS. 6-8, the engagement openings 58, 59 are formed into respective engagement recesses or cutouts in the outer construct 60 when the outer locking tabs 35, 36 are folded against the inner sides of the outer side panels 27, 29. In embodiments, the engagement recesses 58, 59 can have the shape of half an oval and can extend along the lower edges of the outer side panels 27, 29. In exemplary embodiments, the outer locking tabs 35, 36 can be folded and glued to the respective outer side panels 27, 29 (e.g., by a packaging manufacturer) and then stored and/or transported (e.g., to a packer) in a flat, glued blank configuration (not shown), such as in stacks with other similar or identical blanks and/or with the first blanks 1.

As shown in FIGS. 6, the erected outer construct 61 can be formed from the flat, glued blank 25 (e.g., by a folder-gluer system, a packer, etc.) by folding the outer side panels 27, 29 along the lateral fold lines 26.1, 26.3 to extend downwardly from the top panel 26, folding the outer end flaps 46, 49 and 47, 48 along the respective longitudinal fold lines 27.1, 29.1 and 27.2, 29.1 over the respective ends of the outer construct 61, and folding the outer end panels 30, 28 along the respective longitudinal fold lines 26.4, 26.2 over the respective ends of the outer construct 61. In the illustrated embodiments, the outer side end flaps 46, 47, 48, 49 can be folded to extend between the outer side panels 27, 29 and perpendicular to the outer side panels 27, 29. In embodiments, the first outer end panel 28 can overlap and can be secured (e.g., adhered) to the outer side end flaps 47, 48 to form a first outer end wall, and the second outer end panel 30 can overlap and can be secured (e.g., adhered) to the outer side end flaps 46, 49 to form a second outer end wall. As shown in FIGS. 6-8, the top panel 26, the outer panels 27, 28, 29, 30, and the outer end flaps 46, 47, 48, 49 can extend at least partially around a second interior of the outer construct 61, wherein the inner construct 60 is at least partially received in the second interior of the outer construct 61 when the carton 68 is in its closed configuration. In the illustrated embodiments, erected outer construct 61 can have a second or outer opening 62, and the inner construct 60 can be movable into and out of the second interior of the outer construct 61 through the second opening when the locking tabs are disengaged from one another as described in more detail below. As shown in FIGS. 6-8, the second locking edges 45.1, 45.2 can face away from the outer opening 62 and toward the top panel 26 and can be spaced apart from the outer opening 62 and the top panel 26. The outer construct 61 could be otherwise formed without departing from the disclosure.

FIG. 6 shows the constructs 60, 61 in a separated or open configuration (e.g., so that the first opening 65 of the inner construct 61 is accessible for loading and/or removing items from the inner construct 61). In the illustrated embodiments, the second opening 62 of the outer construct 49 is aligned with the first opening 65 of the inner construct 61 in preparation for assembling the carton 68 in its closed configuration (FIGS. 7-8). In embodiments, FIGS. 6-8 show the internal or otherwise hidden aspects of the constructs 60, 61 in broken lines. When the outer construct 60 is moved onto the inner construct 61 to assemble the carton 68 in its closed configuration, the second locking edges 45.1, 45.2 of the outer construct 60 move past the first locking edges 13.1, 13.2, 14.1, 14.2 of the inner construct so that the second locking edges 45.1, 45.2 are arranged below the first locking edges 13.1, 13.2, 14.1, 14.2 (FIG. 8). As shown in FIGS. 8, when the carton 68 is in its closed/locked configuration, the inner locking edges 13.1, 13.2, 14.1, 14.2 face away from the top panel 26 of the outer construct 60 and are spaced apart from the top panel 26 and the outer locking edges 45.1, 45.2 face away from the bottom panel 2 of the inner construct 61 and are spaced apart from the bottom panel 27. In embodiments, the carton 68 could be assembled by moving the outer construct 60 onto the inner construct 61, moving the inner construct 61 into the outer construct 60, or moving both constructs 60, 61 together. In the present disclosure, FIGS. 6-8 illustrate the engagement and disengagement of the locking features on one side of the carton 68 (e.g., the side corresponding to inner side panel 5 and outer side panel 29), with the locking features including the outer locking tab 36, outer locking edge 45.1, engagement hole 51.1, inner locking tabs 10.1, 10.2, inner locking flap 20, inner locking edges 14.1, 14.2, and distal edge 20.1, some of which may be shown in dashed lines in one or more views. The locking features on the opposite side of the carton 68 (e.g., the side corresponding to the inner side panel 3 and outer side panel 27) are not shown in detail in FIGS. 6-8, but the opposite side locking features can include outer locking tab 35, outer locking edge 45.2, engagement hole 50.1, inner locking tabs 9.1, 9.2, inner locking flap 19, inner locking edges 13.1, 13.2, and distal edge 19.1. The opposite side locking features not shown can be identical to the locking features shown in FIGS. 6-8 and can operate in the same manner described herein. Alternatively, the opposite side locking features could be otherwise configured without departing from the disclosure. Further, the locking features on both sides of the carton 68 can be engage and/or disengaged in a similar manner as described herein, with the audible locking sound being created by the inner locking flaps 19, 20 on both sides of the carton 68 without departing from the disclosure.

In the illustrated embodiment, the inner locking flaps 19, 20 are moveable relative to the respective inner side panels 3, 5 of the inner construct 61 to create an audible sound upon positioning the inner construct 61 to the locked position of the carton 68 wherein the inner construct is received in the outer construct 60. The locking flaps 19, 20 are spaced apart from respective adjacent locking tabs 9.1, 9.2, 10.1, 10.2 that are attached to the respective inner side panels 3, 5. As shown in FIGS. 7 and 8, when the inner construct 61 is received in the outer construct 60, the inner locking flaps 19, 20 are pressed inward by the respective outer locking tabs 35, 36 as the inner construct is received in the outer construct. As the inner construct 61 is further inserted into the outer construct 60, the distal edges 19.1, 20.1 of the inner locking flaps 19, 20 pass the second outer locking edges 45.1, 45.2 which causes the inner locking flaps 19, 20 to press against and contact the outer side panels 27, 29 of the outer construct 60 as the inner construct is fully inserted into the outer construct. The foldable connection of the inner locking flaps 19, 20 at the fold lines 21, 22 biases the inner locking flaps 19, 20 outwardly relative to the inner side panels 3, 5. The bias of the inner locking flaps 19, 20 causes the contact with the outer side panels 27, 29 and the resulting audible "clicking" sound that results and indicates that the carton 68 has been positioned to the locked position with the locking edges 13.1, 13.2, 14.1, 14.2 of the locking tabs 9.1, 9.2, 10.1, 10.2 and the distal edges 19.1, 19.2 of the inner locking flaps 19, 20 being positioned above the outer locking edges 45.1, 45.2 of the outer locking tabs 35, 36. The inner locking flaps 19, 20 snap outward as the inner construct 61 is fully inserted into the outer construct 60 contacting the outer side walls 27, 29 and causing the audible sound that indicates the carton 68 is locked.

In addition, when the outer construct 60 and the inner construct 61 are pushed together, the inner locking flaps 19, 20 produces a clearly perceptible sound which clearly signals to a user that the carton 68 is locked. The sound can be referred to in this application as a locking sound and can be a clicking sound or a tapping sound. The locking sound is caused by the movement of the inner locking flaps 19, 20 against the inner surface of the outer side panels when the inner construct 61 is received in the outer construct 60. As the inner locking flaps 19, 20 no longer contact the outer locking tabs 35, 36, there is a gap between the inner locking flap 19, 20 and a respective outer side wall 27, 29. The biasing force of each of the inner locking flaps 19, 20 causes the inner locking flaps to move away from the inner side panels 3, 5 and move into the gap between the inner locking flaps 19, 20 and the outer side walls 27, 29 and contact the outer side walls thus generating the audible locking sound.

In the illustrated embodiments, the carton 68 can be locked in its closed configuration (e.g., due to the position of the second locking edges 45.1, 45.2 below the first locking edges 13.1, 13.2, 14.1, 14.2). For example, the second locking edges 45.1, 45.2 can face the first locking edges 13.1, 13.2, 14.1, 14.2 and so that attempting to move the constructs 60, 61 relative to one another can cause the first locking edges 13.1, 13.2, 14.1, 14.2 and the respective outer locking edges 45.1, 45.2 to engage (e.g., contact, abut, interact, etc.). In embodiments, the abutment of the first locking edges 13.1, 13.2, 14.1, 14.2 against the respective second locking edges 45.1, 45.2 can limit or prevent relative movement between the constructs 60, 61 to limit or prevent undesired extraction of the inner construct 61 from the opening 62 of the outer construct 60. Accordingly, in embodiments, the inner locking tabs 9.1, 9.2, 10.1, 10.2 can engage the respective outer locking tabs 35, 36 (e.g., along the respective locking edges 13.1, 13.2, 14.1, 14.2 and 45.1, 45.2) so that the locking tabs 9.1, 9.2, 10.1, 10.2 cooperate to limit movement of the inner construct 61 relative to the outer construct 60. Furthermore, the distal edges 19.1, 20.1 of the inner locking flaps 19, 20 also interfere/contact the second locking edges 45.1 to prevent movement of the inner construct 61 relative to the outer construct 60 in the locked position of the carton 68. The carton 55 could be otherwise formed and/or erected without departing from the disclosure.

In exemplary embodiments, the carton 68 can be manipulated to overcome the locking engagement of the inner locking tabs 9.1, 9.2, 10.1, 10.2 and inner locking flaps 19, 20 with the outer locking tabs 35, 36 so that the inner construct 61 can be moved from the first (e.g., closed or locked) position (e.g., wherein the inner construct 61 is partially or fully contained within the outer construct 60 with the first opening 65 covered by the outer construct 60) to the second (e.g., open) position (e.g., wherein the inner construct 61 is removed from the outer construct 60 through the opening 62 so that the first opening 65 is accessible). For example, the covers 54, 55 of the engagement devices 50, 51 are separated from the respective outer side panels 27, 29 along the respective weakening lines 52, 53 (e.g., by grasping the covers 54, 55 at the access openings 56, 57). In embodiments, the removal of the covers 54, 55 can provide a first opening protection for the carton 68. In the illustrated embodiments, the removal of the covers 54, 55 can form engagement holes 51.1, 51.2 (FIG. 6) in the respective outer side panels 27, 29 so that the inner locking tabs 9.1, 9.2, 10.1, 10.3 and the inner locking flaps 19, 20 of the inner construct 61 are accessible through the openings formed by the respective engagement devices 50, 51 in the outer construct 60. In the illustrated embodiments, a user can grip the engagement holes 50.1, 51.1 formed by the engagement devices 50, 51 (e.g., with the thumb and index finger of one hand) and press the inner side panels 3, 5, the inner locking tabs 9.1, 9.2, 10.1, 10.2, and/or the inner locking flaps 19, 20 inwardly, causing the first locking edges 13.1, 13.2, 14.1, 14.2 and/or the distal edges 19.1, 20.1 to move inwardly and away (out of alignment with) from the second locking edges 45.1, 45.2. When the inner locking tabs 9.1, 9.2, 10.1, 10.2 and the inner locking flaps 19, 20 of the inner construct 61 are pressed inwardly in this way, the second locking edges 45.1, 45.2 of the outer construct 60 are no longer blocked by the first locking edges 13.1, 13.2, 14.1, 14.2 and/or the distal edges 19.1, 19.2 of the inner construct 17. In one embodiment, a central portion of the inner side panels 3, 5 can be pressed inwardly via the engagement holes 50.1, 51.1 a sufficient amount so as to cause the first locking edges 13.1, 13.2, 14.1, 14.2 and the distal edges 19.1, 19.2 to be clear of the second locking edges 45.1, 45.2 and the inner construct 61 is free to move relative to the outer construct 60.

While pressing the inner side panels 3, 5 inwardly and engaging the inner locking tabs 9.1, 9.2, 10.1, 10.2 and the inner locking flaps 19, 20 via the openings formed by the engagement devices 50, 51, the user can grip the inner construct 61 via the engagement recesses 58, 59 in the outer construct 60 (e.g., with the thumb and index finger of the other hand). The user can pull the constructs 60, 61 apart with both hands while pressing inwardly on the side panels 3, 5 via the openings formed in the outer construct 60 by the engagement devices 50, 51 causing the inner locking flaps 19, 20 and the inner locking tabs 9.1, 9.2, 10.1, 10.2 to disengage with the locking edges 45.1, 45.2 and by pulling on the inner construct 61 via the engagement recesses 58, 59 in the outer construct 60. In embodiments, it is difficult or impossible for a child to carry out the unlocking and opening operation (e.g., due to limitations in hand size and/or dexterity).

In the illustrated embodiments, once the constructs 60, 61 are separated (e.g., similar as shown in FIG. 6), the opening 65 of the inner construct 61 is accessible for removing or adding items. The carton 68 could be reclosed and/or reopened according to the assembling and unlocking/separating operations as described above. In embodiments, the reclosed carton 68 is again protected against unwanted opening (e.g., by children) by the locking engagement of the inner locking tabs 9.1, 9.2, 10.1, 10.2 with the respective outer locking tabs 35, 36 once the inner construct 61 is fully inserted into the outer construct 60. Upon reclosing the carton 68, the audible locking sound is generated by the inner locking flaps 19, 20 in the same manner as described above for the initial closing and locking of the carton 68.

In exemplary embodiments, the shortest distance of the engagement features 50, 51 and/or the engagement recesses 58, 59 from each other along the outer sides of the carton 68 in its closed configuration is dimensioned such that it is difficult or impossible for a child (e.g., with an age of up to three years, of up to four years, of up to five years, of up to six years, etc.) to unlock the carton 68, and it is difficult or impossible to pull the outer construct 60 and inner construct 61 apart when in the locked configuration. In embodiments, this dimensioning is based on average body measurements of a child, regardless of gender, in the respective age group, in the EU or in North America, depending on the region for which the everted box is intended. In examples, the distance between the outer sides of the second side walls can be about 50 to about 120 mm, about 70 to about 100 mm, about 60 to about 90 mm, about 80 to about 90 mm, or about 70 to about 80 mm. This can help ensure that a child's hands cannot engage in all the engagement holes simultaneously in order to unlock the folding carton, while an adult (e.g., who may have larger hands) is able to reach the locking features to unlock and open the carton 68.

In the carton 68 according to the present disclosure, the inner locking tabs 9.1, 9.2, 10.1, 10.2 and the inner locking flaps 19, 20 and the outer locking tabs 35, 36 form an interlock when the inner construct 61 is moved into the outer construct 60. This is because the inner locking edges 13.1, 13.2, 14.1, 14.2 and distal edges 19.1, 19.2 can bear against the outer locking edges 45.1, 45.2 so that they prevent the inner construct 61 from being pulled out of the outer construct 60. Pulling the inner construct 61 out of the outer construct 60 can require, for example, that the interlock between the outer part and the inner part be released. To do this, the user can use the thumb and index finger of one hand to engage the engagement openings of the access features 50, 51 and compress the inner side panels 3, 5 inwardly and engaging the inner locking tabs 9.1, 9.2, 10.1, 10.2 and the inner locking flaps 19, 20 via the openings formed by the engagement devices 50, 51, so that the outer locking edges 45.1, 45.2 no longer block the path of the inner locking edges 13.1, 13.2, 14.1, 14.2 and distal edges 19.1, 20.1. With the thumb and index finger of the other hand, the user can grip a portion of the inner construct 61 (e.g., along or adjacent the bottom panel 2) through the second engagement openings/recesses 58, 59 and pull the inner construct 61 and outer construct 60 apart. In doing so, the inner locking flaps 19, 20 and the inner locking tabs 9.1, 9.2, 10.1, 10.2 slide past the user's thumb and index finger that engage the engagement apertures of the access features 50, 51 and compress the inner locking flaps 19, 20 and the inner locking tabs 9.1, 9.2, 10.1, 10.2 slightly. Unlocking by a child may be prevented or made difficult by sizing the carton 68 so that the child, due to the comparatively small size of the child's hands, is not able to engage in the engagement openings of the access features 50, 51 in the manner described. Unlocking can require, for example, a certain understanding of the function of the latch, which is usually not yet present in a child up to the age of six, for example. As a result, a child is prevented from unlocking the carton 68 according to the disclosure and is protected from the associated dangers. In addition, the carton 68 is protected against unintentional opening, which can occur with an everting carton that does not include the locking features, for example, if it is lifted at the outer construct without supporting the inner construct so that the inner construct slips out of the outer construct in the absence of the locking features.

In exemplary embodiments, the carton 68 may have tolerances in its formation, for example, when the constructs 60, 61 are formed from the flat, glued blanks 1, 25 by a packager. These tolerances may lead to small variations in the relative sizes of the constructs 60, 61. However, the two layers of thickness of the inner locking tabs 9.1, 9.2, 10.1, 10.2 and of the outer locking tabs 45.1, 45.2 (e.g., where their respective proximal and distal portions are in overlapping relationships) can help compensate for such tolerances and variations that can occur during the production of the blanks and the erection and bonding of the inner construct and/or the outer construct. This can be advantageous for secure locking of the carton despite the tolerances.

The blanks according to any of the embodiments of the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the exemplary embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton comprising:

an inner construct comprising a plurality of inner panels extending at least partially around a first interior of the inner construct, wherein the inner construct comprises an inner locking tab foldably connected to at least one inner panel of the plurality of inner panels at an edge, wherein the inner locking tab has a tab engagement edge positioned a first distance from the edge; and an inner locking flap foldably connected to the at least one inner panel of the plurality of inner panels, wherein the inner locking flap includes a flap engagement edge positioned a second distance from the edge, wherein the first distance is greater than the second distance;

an outer construct comprising a plurality of outer panels extending at least partially around a second interior of the outer construct, the inner construct being at least partially received in the second interior of the outer construct and positionable to a locked position wherein movement of the inner construct relative to the outer construct is restricted, the outer construct comprises an outer locking tab foldably connected to at least one outer panel of the plurality of outer panels, and the inner locking tab limits movement between the inner construct and the outer construct at the locked position; and an engagement feature extending in the at least one outer panel of the outer construct, the engagement feature comprising an engagement hole in the at least one outer panel, at least one of the inner locking tab and the inner locking flap of the inner construct are adjacent the engagement feature in the outer construct at the locked position so that the at least one of the inner locking tab and the inner locking flap is positioned for disengagement with the outer locking tab via the engagement hole for facilitating movement of the inner construct and the outer construct relative to one another from the locked position to an open position wherein the first interior of the inner construct is accessible.

2. The carton of claim 1, wherein the inner locking tab is attached to the at least one inner panel.

3. The carton of claim 2, wherein the inner locking tab is a first inner locking tab and the carton comprises a second inner locking tab attached to the at least one inner panel.

4. The carton of claim 2, wherein the inner locking flap is adjacent and spaced apart from each of the first inner locking tab and the second inner locking tab.

5. The carton of claim 4, wherein the inner locking flap is folded against the at least one inner panel and free from attachment to the at least one inner panel.

6. The carton of claim 1, wherein the at least one inner panel is accessible via the engagement hole and pressed inwardly to facilitate disengagement of the inner locking tab and the inner locking flap from the outer locking tab.

7. The carton of claim 1, further comprising an engagement recess extending in the outer construct, wherein at least a portion of the inner construct extends along at least a portion of the engagement recess in the outer construct so that the inner construct can be gripped via at least the engagement recess in the outer construct.

8. The carton of claim 7, wherein the engagement recess extends along at least a portion of the outer locking tab and the at least one outer panel.

9. The carton of claim 7, wherein the plurality of outer panels of the outer construct comprises a top panel foldably connected to the at least one outer panel, the outer construct comprises an opening opposite to the top panel, the inner construct being selectively movable through the opening, and wherein the engagement feature is closer to the top panel than the opening and the engagement recess extends along the opening.

10. The carton of claim 1, wherein the inner locking tab is a first inner locking tab, the inner locking flap is a first inner locking flap, the at least one inner panel comprises a first inner panel, the outer locking tab is a first outer locking tab, the at least one outer panel comprises a first outer panel, and the engagement feature is a first engagement feature, wherein the inner construct further comprises a second inner locking tab foldably connected to a second inner panel of the plurality of inner panels and a second inner locking flap foldably connected to the second inner panel of the plurality of inner panels, the outer construct further comprises a second outer locking tab foldably connected to a second outer panel of the plurality of outer panels and a second engagement feature extending in the second outer panel, and the second inner locking tab and the second inner locking flap cooperate with the second outer locking tab to limit movement between the inner construct and the outer construct at the locked position, the second inner locking flap being moveable relative to the second inner panel to cooperate with the first inner locking flap to create an audible locking sound upon positioning the inner construct to the locked position.

11. The carton of claim 10, wherein the engagement hole is a first engagement hole, the second engagement feature comprises a second engagement hole, and at least one of the second inner locking tab and the second inner locking flap is positioned for disengagement with the second outer locking tab via the second engagement hole for facilitating movement of the inner construct and the outer construct relative to one another from the locked position to the open position.

12. The carton of claim 11, wherein the tab engagement edge is a first tab engagement edge and the second inner locking tab has a second tab engagement edge and each of the first outer locking tab and the second outer locking tab has a second locking edge facing the respective first or second tab engagement edge for limiting movement between the inner construct and the outer construct at the locked position.

13. The carton of claim 12, wherein the flap engagement edge is a first flap engagement edge and the second inner locking flap has a second flap engagement edge, the first engagement edge of the first inner locking flap and the second flap engagement edge of the second inner locking flap being positioned for engagement with the second locking edge of a respective first outer locking tab and second outer locking tab to cooperate with the first inner locking tab and the second inner locking tab to limit movement between the inner construct and the outer construct at the locked position.

14. The carton of claim 1, wherein the inner construct comprises an opening for inserting and/or removing items from the first interior, the opening in the inner construct being at least partially enclosed by the outer construct.

15. In combination, a first blank and a second blank for cooperating to at least partially form a carton, the first blank comprising a plurality of inner panels, an inner locking tab foldably connected to at least one inner panel of the plurality of inner panels at an edge, wherein the inner locking tab has a tab engagement edge positioned a first distance from the edge when an inner construct of the carton is formed from the first blank, and an inner locking flap foldably connected to the at least one inner panel of the plurality of inner panels, wherein the inner locking flap includes a flap engagement edge positioned a second distance from the edge when the inner construct is formed from the first blank, wherein the first distance is greater than the second distance;

the second blank comprising a plurality of outer panels and an outer locking tab foldably connected to at least one outer panel of the plurality of outer panels, wherein the second blank is for forming an outer construct for at least partially receiving the inner construct formed from the first blank when the carton is formed from the first blank and the second blank, and wherein the inner locking tab limits movement between the inner construct formed from the first blank and the outer construct formed from the second blank in a locked position of the carton formed from the first blank and the second blank; and an engagement feature extending in the at least one outer panel of the second blank, the engagement feature comprising an engagement hole in the at least one outer panel, wherein the engagement feature is for accessing at least one of the inner locking tab and the inner locking flap for disengagement with the outer locking tab via the engagement hole for facilitating movement of the inner construct and the outer construct relative to one another from the locked position to an open position of the carton formed from the first blank and the second blank.

16. The combination of claim 15, wherein the inner locking tab is a first inner locking tab for being attached to the at least one inner panel, the first blank comprises a second inner locking tab for being attached to the at least one inner panel, the inner locking flap is adjacent and spaced apart from each of the first inner locking tab and the second inner locking tab.

17. The combination of claim 15, further comprising an engagement opening extending in the second blank for forming an engagement recess when the outer construct is formed from the second blank for facilitating gripping of the inner construct formed from the first blank when the carton is formed from the first blank and the second blank.

18. The combination of claim 17, wherein the outer locking tab is foldably connected to the at least one outer panel along a fold line, and the engagement opening extends in at least a portion of the outer locking tab and the at least one outer panel along the fold line.

19. The combination of claim 17, wherein the plurality of outer panels of the second blank comprises a top panel foldably connected to the at least one outer panel opposite to the outer locking tab, and wherein the engagement feature is closer to the top panel than the outer locking tab and the engagement opening extends in the at least one outer panel and the outer locking tab.

20. The combination of claim 15, wherein the inner locking tab is a first inner locking tab, the inner locking flap is a first inner locking flap, the at least one inner panel comprises a first inner panel, the outer locking tab is a first outer locking tab, the at least one outer panel comprises a first outer panel, and the engagement feature is a first engagement feature, wherein the first blank further comprises a second locking tab foldably connected to a second inner panel of the plurality of inner panels and a second inner locking flap foldably connected to the second inner panel of the plurality of inner panels, the second blank further comprises a second outer locking tab foldably connected to a second outer panel of the plurality of outer panels and a second engagement feature extending in the second outer panel, and the second inner locking tab and the second inner locking flap cooperate with the second outer locking tab to limit movement between the inner construct formed from the first blank and the outer construct formed from the second blank at the locked position when the carton is formed from the first blank and the second blank, the second inner locking flap being moveable relative to the second inner panel to cooperate with the first inner locking flap to create an audible locking sound upon positioning the inner construct to the locked position in the carton formed from the first blank and the second blank.

21. The combination of claim 20, wherein the engagement hole is a first engagement hole, wherein the second engagement feature comprises a second engagement hole in the second outer panel.

22. A method of forming a carton, the method comprising:

obtaining a first blank comprising a plurality of inner panels, an inner locking tab foldably connected to at least one inner panel of the plurality of inner panels at an edge, and an inner locking flap foldably connected to the at least one inner panel of the plurality of inner panels at the edge;

forming an inner construct from the first blank by folding the plurality of inner panels at least partially around a first interior of the inner construct, wherein the inner locking tab has a tab engagement edge positioned a first distance from the edge and wherein the inner locking flap includes a flap engagement edge positioned a second distance from the edge, wherein the first distance is greater than the second distance;

obtaining a second blank comprising a plurality of outer panels and an outer locking tab foldably connected to at least one outer panel of the plurality of outer panels, an engagement feature extending in the at least one outer panel, the engagement feature comprising an engagement hole in the at least one outer panel;

forming an outer construct from the second blank by folding the plurality of outer panels at least partially around a second interior of the outer construct;

moving at least one of the inner construct and the outer construct relative to the other to assemble the carton with the inner construct at least partially received in the second interior of the outer construct and in a locked position, wherein the inner locking tab and limits movement between the inner construct and the outer construct at the locked position;

at least one of the inner locking tab and the inner locking flap is accessible via the engagement hole for disengagement with the outer locking tab for facilitating movement of the inner construct and the outer construct relative to one another from the locked position to an open position.

23. The method of claim 22, wherein the inner locking tab is a first inner locking, the first blank comprises a second inner locking tab, the inner locking flap is adjacent and spaced apart from each of the first inner locking tab and the second inner locking tab, the forming the inner construct comprises folding the first inner locking tab and second inner locking tab and attaching each of the first inner locking tab and the second inner locking tab to the at least one inner panel.

24. The method of claim 22, further comprising an engagement opening extending along at least a portion of the outer locking tab and the at least one outer panel in the second blank, wherein the forming the outer construct comprises folding the outer locking tab into an overlapping relationship with the at least one outer panel, which forms the engagement opening into an engagement recess of the outer construct for facilitating gripping the inner construct.

25. The method of claim 24, further comprising disengaging the at least one of the inner locking tab and the inner locking flap from the outer locking tab via the engagement hole, gripping the inner construct via the engagement recess, and moving the inner construct relative to the outer construct to the open position allowing access to the first interior of the inner construct.

26. The method of claim 22, wherein the inner locking tab is a first inner locking tab, the inner locking flap is a first inner locking flap, the at least one inner panel comprises a first inner panel, the outer locking tab is a first outer locking tab, the at least one outer panel comprises a first outer panel, and the engagement feature is a first engagement feature, wherein the first blank further comprises a second locking tab foldably connected to a second inner panel of the plurality of inner panels and a second inner locking flap foldably connected to the second inner panel of the plurality of inner panels, the second blank further comprises a second outer locking tab foldably connected to a second outer panel of the plurality of outer panels and a second engagement feature extending in the second outer panel, and the second inner locking tab and the second inner locking flap cooperate with the second outer locking tab to limit movement between the inner construct formed from the first blank and the outer construct formed from the second blank at the locked position when the carton is formed from the first blank and the second blank, the moving the at least one of the inner construct and the outer construct relative to each other comprises the first inner locking flap moving relative to the first inner panel and the second inner locking flap moving relative to the second inner panel to create an audible locking sound when the inner construct is moved to the locked position.

27. The method of claim 22, wherein the inner construct comprises an opening for inserting and removing items from the first interior, the opening in the inner construct being at least partially enclosed by the outer construct in the closed position and being accessible in the open position.

* * * * *